US005940661A

United States Patent [19]

Yagi et al.

[11] Patent Number: 5,940,661

[45] Date of Patent: Aug. 17, 1999

[54] IMAGE FORMING APPARATUS WITH A CHARGING MEMBER WHICH REMOVES SMEARS ON AN IMAGE FORMING MEMBER

[76] Inventors: Masataka Yagi; Tamotsu Sakuraba; Tetsumaru Fujita; Narutaka Yoshida; Akira Hirota; Tsugihito Yoshiyama; Masami Matsuura; Yasuhiro Nakagami; Masayasu Haga, all c/o Minolta Co., Ltd., Osaka Kokusai Building, 3-13, 2, 2-Chome, Azuchi-Machi, Chuo-Ku, Osaka-Shi, Osaka 541-8556, Japan

[21] Appl. No.: 09/022,472

[22] Filed: Feb. 12, 1998

[30] Foreign Application Priority Data

| | | | |
|---|---|---|---|
| Feb. 13, 1997 | [JP] | Japan | 9-029318 |
| Feb. 13, 1997 | [JP] | Japan | 9-029459 |
| Feb. 13, 1997 | [JP] | Japan | 9-029460 |
| Apr. 7, 1997 | [JP] | Japan | 9-087833 |
| Nov. 25, 1997 | [JP] | Japan | 9-322572 |

[51] Int. Cl.[6] ..... G03G 15/02

[52] U.S. Cl. ..... 399/174; 399/343; 399/345; 399/350; 399/351

[58] Field of Search ..... 399/130, 149, 399/150, 168, 174, 175, 176, 343, 345, 350, 351, 353, 354, 358, 360; 430/31, 902

[56] References Cited

U.S. PATENT DOCUMENTS

| | | | |
|---|---|---|---|
| 5,066,982 | 11/1991 | Hosoya et al. | 399/150 |
| 5,068,762 | 11/1991 | Yoshihara | 399/168 X |
| 5,475,471 | 12/1995 | Kisu et al. | 399/168 X |
| 5,557,375 | 9/1996 | Nagayasu et al. | 399/174 |
| 5,596,395 | 1/1997 | Sawamura et al. | 399/168 |
| 5,630,199 | 5/1997 | To | 399/175 |
| 5,701,559 | 12/1997 | Ootaka | 399/149 |

FOREIGN PATENT DOCUMENTS

| | | |
|---|---|---|
| 04184359 | 7/1992 | Japan . |
| 05341624 | 12/1993 | Japan . |

*Primary Examiner*—William Royer
*Assistant Examiner*—Hoan Tran
*Attorney, Agent, or Firm*—McDermott, Will & Emery

[57] ABSTRACT

An image forming apparatus with a charging member that allows easy removal of smears from an image forming drum. The apparatus removes smears from the image forming drum by placing a different portion of the charging member in contact with the drum. The apparatus uses a cam or a solenoid to press on the charging member to cause a different portion of the charging member to come into contact with the image forming drum.

35 Claims, 23 Drawing Sheets

IMAGE FORMING APPARATUS WITH A CHARGING MEMBER WHICH REMOVES SMEARS ON AN IMAGE FORMING MEMBER

This application is based on patent applications Nos. 9-29318 Pat., 9-29459 Pat., 9-29460 Pat., 9-87833 Pat. and 9-322572 Pat. filed in Japan, the contents of which are hereby incorporated by reference.

BACKGROUND OF THE INVENTION

1. Field of the Invention

The present invention relates to an image forming apparatus such as a copying machine and a printer.

2. Description of the Background Art

Image forming apparatuses such as a copying machine and a printer generally employs electrophotographic system, in which a surface of an electrostatic latent image carrier is uniformly charged, and an electrostatic latent image is formed by effecting image exposure corresponding to an original image or image data on a charged region of the image carrier surface. The electrostatic latent image thus formed is developed into a visible image, which is immediately transferred onto a transfer member and is fixed. In a color image forming apparatus, the visible image is transferred onto an intermediate image carrier (intermediate transfer member), and then is transferred from the intermediate image carrier onto a transfer member and is fixed.

A charging device is used for charging the surface of the electrostatic latent image carrier or charging the intermediate image carrier for the purpose of transferring the visible image onto the intermediate image carrier.

Various types of charging devices have been proposed and available. Some types of the charging devices employ charging members, each of which has a contact portion in contact with the surface of the image carrier and charges a predetermined surface by performing discharging from a discharge contributing surface other than the contact portion, or employ charging members, each of which is spaced from the surface of the image carrier surface by a predetermined short distance, and charges the predetermined surface by performing discharging from the discharge contributing surface. In these types of charging devices, however, the charging surface may be smeared by toner for development, paper powder, adhesive or the like adhering onto the discharge contributing surface due to some reasons. This smear may impede smooth and uniform discharging, resulting in noises on images.

For example, an image forming apparatus of a cleanerless type is known. In this apparatus, a dedicated cleaner is not used, but developer which remains on the electrostatic latent image carrier without being transferred onto the transfer member is removed and collected by a developing/cleaning device simultaneously with development. In the image forming apparatus of this type, the discharge contributing surface of the charging member is often smeared by untransferred residual developer, paper powder, adhesive or the like which remain on the electrostatic latent image carrier even after the transfer of the visible image from the electrostatic latent image carrier onto the transfer member or the intermediate image carrier. In the image forming apparatus provided with the dedicated cleaner for removing untransferred residual developer from the image carrier, the discharge contributing surface of the charging member is often smeared by the developer, paper powder and others which passed through the cleaner.

For overcoming the above problems, it has been proposed, for example, to add a cleaning device for the charging member to the charging device. Also, it has been proposed to add a device for reducing a pressure of the charging member against the image carrier or add a device for making a space between them in order to allow easy passage of the untransferred residual developer between the charging member and the image carrier. In these manners, smear of the charging members can be suppressed.

However, these proposals, i.e., addition of the device such as a cleaning device, a pressure reducing device or a space making device to the charging device, unpreferably increase sizes of the image forming apparatus, complicate the structure thereof, and therefore increase a manufacturing cost.

Many image forming apparatuses of the cleanerless type employ charging members of a brush type as devices for charging the image carriers prior to image exposure. The purpose thereof is to disperse the untransferred residual toner by the charging member of the brush type so that the residual toner may not cause disadvantages such as exposure eclipse in the next image exposure for forming the electrostatic latent image.

The charging member of the brush type is used for shaving off the surface of the image carrier.

The shaving of the surface of the image carrier is required for shaving off discharge products, i.e., materials produced by discharging if the image carrier is an organic photosensitive member. More specifically, discharge products such as ozone produced by discharging from the charging device adhere onto the photosensitive member, and the adherent materials absorbs moisture so that the surface of the photosensitive member becomes electrically conductive, and this conductive state causes failure in image exposure. Regardless of whether the image carrier is an organic photosensitive member or not, toner adhered onto the surface of the image carrier forms a film due to the cleanerless structure. This toner film impedes the image exposure so that appropriate shaving of the surface of the image carrier is required for preventing this in addition to the foregoing purpose.

However, in the conventional image forming apparatus of the cleanerless type in which the image carrier surface is shaved off, the shaved surface of the image carrier is liable to have a high roughness. In particular, the charging member of the brush type tends to increase the roughness of the surface shaved thereby. An excessively rough surface roughness of the image carrier causes irregular reflection of light beams during the image exposure, and therefore impedes desired image exposure. For example, in an image forming apparatus performing reversal development, the exposure cannot sufficiently lower a potential on a portion to which toner is to be adhered so that this portion insufficiently carry the toner, resulting in an insufficient density at a final image.

If the shaving is performed to produce an excessively large roughness of the image carrier surface, irregularities in surface roughness occur at various portions on the image carrier surface, which causes irregularities in density at the final image. Locally deep and shallow portions are liable to be formed by the shaving, resulting in stripe noises on the final image.

The foregoing developing/cleaning device in the image forming apparatus of the cleanerless type removes and collects the untransferred residual toner, which still remains on the image carrier surface after the transfer of the visible toner image onto the transfer member, onto the developer carrier by utilizing a potential difference between a developing bias voltage applied to the developer carrier in the developing/cleaning device and the surface potential of the image carrier. For example, in the reversal development, the electrostatic latent image region on the image carrier surface, which carries the potential lowered by the image exposure, is electrostatically supplied with developer toner from the developer carrier for development, as is done also in an ordinary reversal development, and simultaneously the residual toner, which remains on the image carrier after the last transfer and particularly stays on a non-image portion not subjected to the exposure, is electrostatically absorbed and collected onto the developer carrier owing to the potential difference between the surface potential on the image carrier charged by the charging device and the developing bias.

However, various kinds of transfer sheets or members are now available for use in copying machines and printers. Some of them may contain special materials at their surfaces which affect the image carrier or its peripheral equipments. Also, some kinds of transfer members may carry adhesive or a large amount of paper powder thereon. If these kinds of transfer members are used many times, foreign matters such as special materials, adhesive or paper powder adhere onto the image carrier so that black or blank spots appear in the final image. This is for the following reason. Since the charging device cannot charge the image carrier portions carrying such foreign matters so that the developing/cleaning device develops these portions in spite of the fact that these portions are non-image portions. Alternatively, regions which are to be developed but carry the foreign matters cannot carry the toner transferred thereto so that white blanks are formed. If the foreign matters are large in size, white blanks are formed also around those regions.

The image forming apparatuses employ charge applying devices or charging devices for charging the image carrier surface, for example, as described above. Among these charge applying devices, charge applying devices of a contact type are advantageous and, particularly, devices provided with charging members of a sheet-like or brush-like form are more advantageous than devices employing roller-like form in view of small and simple structures. However, these types of devices may suffer from variation and irregularity in charge applying performance due to deposition of foreign matters such as paper powder or toner at its portion which is in contact with a charge target member, i.e., member to be charged, and therefore requires appropriate measures against it. As already discussed and as disclosed, for example, in Japanese Laid-Open Patent Publication No. 4-184359 (184359/1992), some conventional charge applying devices are provided with mechanisms for removing foreign matters by releasing the charging member from the charge target member.

However, provision of the mechanism for releasing the pressure complicates the structure of the apparatus, which may cancel the advantage achieved by employing the charging member in a sheet or brush form. However, if the pressure is not released, it is impossible to remove sufficiently the foreign matters adhering to or deposited on the portions of the charging member in contact with the charge target member so that variation or irregularity in charging performance may occur. This may result in stripe noises in images produced by the image forming apparatus.

SUMMARY OF THE INVENTION

An object of the invention is to provide an image forming apparatus which can overcome one or more of the foregoing problems in the prior art, and thereby can form an image of a good quality containing no or less noises.

Also, an object of the invention is to provide an image forming apparatus in which one or more charging devices provided for an image carrier allows easy removal of smear from a charging member(s) without particularly increasing or complicating the structure of the image forming apparatus.

Still another object of the invention is to provide an electrophotographic image forming apparatus of a cleanerless type, wherein a roughness of a surface of an image carrier can be kept at an allowable level, and thereby reduction and irregularities in image density can be suppressed.

Further, an object of the invention is to provide an electrophotographic image forming apparatus, in which a visible toner image formed on an image carrier having a moving surface is transferred onto a transfer target member, i.e., member receiving the transferred image, and a developing/cleaning device performs cleaning simultaneously with development for removing toner remaining on the image carrier after the transfer of the visible toner image. More specifically, in this apparatus, the developing/cleaning device can collect untransferred residual toner, and foreign matters such as special material, adhesive and paper powder adhering to the image carrier surface can be removed, so that it is possible to suppress image noises such as black spots and blank spots which are liable to appear due to such foreign matters.

Further, an object of the invention is to provide an image forming apparatus, in which a simple mechanism can remove foreign matters adhering to and deposited on contact portions of a charging member in a charging device and a charge target member, so that an intended charging performance can be kept and thereby an image of a good quality having less image noises can be formed.

According to aspects of the invention, there are provided image forming apparatuses of the following four types (1)–(4).

(1) First Type of the Image Forming Apparatus

An image forming apparatus comprising: at least one charging device opposed to a moving surface of an image carrier, at least one of said charging device including a charging member to be supplied with a charging voltage and having a smooth surface opposed to said image carrier, and said smooth surface of said charging member having a discharge contributing surface contributing to discharging to said image carrier; and a charging member drive device for bringing said smooth surface having said discharge contributing surface into contact with the moving surface of said image carrier and relatively sliding said discharge contributing surface with respect to said image carrier surface.

According to this image forming apparatus, the image carrier is uniformly charged prior to formation of an electrostatic latent image, the electrostatic latent image is formed at a charged region by image exposure or the like, and the electrostatic latent image is developed into a visible toner image, which is transferred onto a transfer target member such as a transfer member or an intermediate image carrier. In either case, the visible toner image is finally transferred onto the transfer member and is fixed.

In the above charging device, the charging member has the smooth surface opposed to the image carrier, and the charging member drive device brings the surface in the smooth surface of the charging member contributing to discharging to the image carrier into contact with the moving surface of the image carrier and slides the discharge contributing surface relatively to the image carrier surface.

Therefore, smear by toner or the like adhered onto the discharge contributing surface is easily scrubbed away owing to relative sliding contact between the discharge contributing surface and the image carrier surface so that the discharge contributing surface can be kept clean, and image carrier and adherent matters on the image carrier can be charged in an intended manner.

Further, the smear on the discharge contributing surface of the charging member can be removed without requiring an additional cleaning device for the charging member, or an addition of device for reducing a pressure of the charging member against the image carrier or spacing them from each other. Therefore, the image forming apparatus does not require a significantly large and/or complicated structure.

(2) Second Type of the Image Forming Apparatus

An electrophotographic image forming apparatus of a cleanerless type, wherein a plurality of contact members are in contact with a surface of an image carrier, one of the plurality of contact members shaving said image carrier surface to the highest extent has a contact surface being in contact with the image carrier surface and having high smoothness, compared with the other of the plurality of contact members.

The electrophotographic image forming apparatus of the cleanerless type is an apparatus of such a type that does not use a cleaner dedicated to removal of untransferred residual toner, but uses another cleaning means such as developing/cleaning device, which collects the residual toner simultaneously with development of the electrostatic latent image, for removing the toner which remains on the image carrier after transfer of a visible image formed on the image carrier.

In this image forming apparatus, the image carrier is uniformly charged prior to image exposure, the electrostatic latent image is formed at a charged region by the image exposure, and the electrostatic latent image is developed into a visible toner image, which is transferred onto a transfer target member such as a transfer member or an intermediate image carrier. In either case, the visible toner image is finally transferred onto the transfer member and is fixed.

The untransferred residual toner, which remains on the image carrier after transfer of the visible toner image onto the transfer target member, is collected and removed by cleaning means such as a developing/cleaning device which can collect and remove the untransferred residual toner simultaneously with the development of the electrostatic latent image.

The image carrier surface is shaved by the plurality of members in contact with the same. However, as a whole, the image carrier surface is shaved in a direction corresponding to the surface roughness of the smooth surface of the contact member being in contact with the image carrier surface and shaving the same to the highest extent.

As a result, the image carrier surface is uniformly shaved to such an extent that an adherent discharge product, toner film or the like on the image carrier are removed. Also, the surface roughness of the image carrier is suppressed to an extent which does not cause significant irregular reflection of a light beam during the image exposure and thereby does not cause reduction in image density. In this manner, various portions of the image carrier surface can be shaved to a uniform extent, and thereby can prevent irregularities in image density. Also, the surface roughness of the image carrier can be kept at a level which does not cause reduction in image density, which may be caused by irregular reflection of the image carrier surface.

(3) Third Type of the Image Forming Apparatus

An electrophotographic image forming apparatus, wherein a developing/cleaning device for performing simultaneous development and cleaning removes toner remaining on the image carrier having a moving surface after transfer onto a transfer target member of a visible toner image formed on the image carrier, a foreign matter removing device is arranged at a section defined in the moving direction of the image carrier surface between the transfer portion and the developing/cleaning device, the foreign matter removing device includes a foreign matter removing member having a foreign matter removing edge portion opposed to the image carrier surface, and the foreign matter removing edge portion is located at a distance ranging from 0 to 200 $\mu$m from the image carrier surface.

In this image forming apparatus, the image carrier is uniformly charged prior to image exposure, the electrostatic latent image is formed at a charged region by the image exposure, and the electrostatic latent image is developed by the developing/cleaning device into a visible toner image, which is transferred onto a transfer target member such as a transfer member or an intermediate image carrier. In either case, the visible toner image is finally transferred onto the transfer member and is fixed.

Foreign matters such as untransferred residual toner, which remain on the image carrier after the transfer of the visible toner image onto the transfer target member, and/or paper powder reach the foreign matter removing device arranged between the transfer portion and the developing/cleaning device. The foreign matter removing edge portion at the foreign matter removing member of the foreign matter removing device is located at a distance of 200 $\mu$m or less from the image carrier during removal of the foreign matters. Therefore, foreign matters larger in size than this distance is checked by the foreign matter removing edge portion. The untransferred residual toner have smaller particle diameters than the foreign matters. Therefore, even if the foreign matter removing member is in contact with the image carrier, it is possible to pass the untransferred residual toner through an area between them by appropriately adjusting, e.g., a pressure between them or, if necessary, by appropriately moving the foreign matter removing member. The untransferred residual toner passed through the position between the foreign matter removing member and the image carrier reaches the developing/cleaning device, and is collected by the same.

Since the foreign matters are removed in this manner, it is possible to suppress image noises such as black spots and blank spots, which are liable to appear due to the foreign matters, and therefore good images can be produced.

(4) Fourth Type of the Image Forming Apparatus

An image forming apparatus provided with a charge target member to be charged and a charging device charging the charge target member, wherein the charging device includes a flexible and unrotational conductive charging member for applying electric charges to the charge target member, the charging member has a leading edge to be pressed obliquely against the charge target member for charging; and a pressing direction changing device is provided for changing a direction of pressing of the unrotational conductive charging member against the charge target member.

In this image forming apparatus, the leading edge of the unrotational conductive charging member in the charging device is pressed obliquely against the charge target member to apply electric charges to the charge target member from the unrotational conductive charging member during an ordinary operation. Thus, application or removal of the electric charges is performed. In this charging device, foreign matters may adhere to the portion of the leading edge of the unrotational conductive charging member, which is in contact with the charge target member, and may be deposited thereon with use. This results in variations and irregularities in charging performance. Therefore, the pressing direction changing device changes the direction of pressing of the flexible unrotational conductive charging member, whereby the adhered and deposited foreign matters drop, and the contact portion is cleaned up. Thereby, the original charging performance is restored.

Two or more of the distinctive structures of the image forming apparatuses of the foregoing first to fourth types may be employed in combination unless no problem arises in image formation.

The foregoing and other objects, features, aspects and advantages of the present invention will become more apparent from the following detailed description of the present invention when taken in conjunction with the accompanying drawings.

Figure 1:
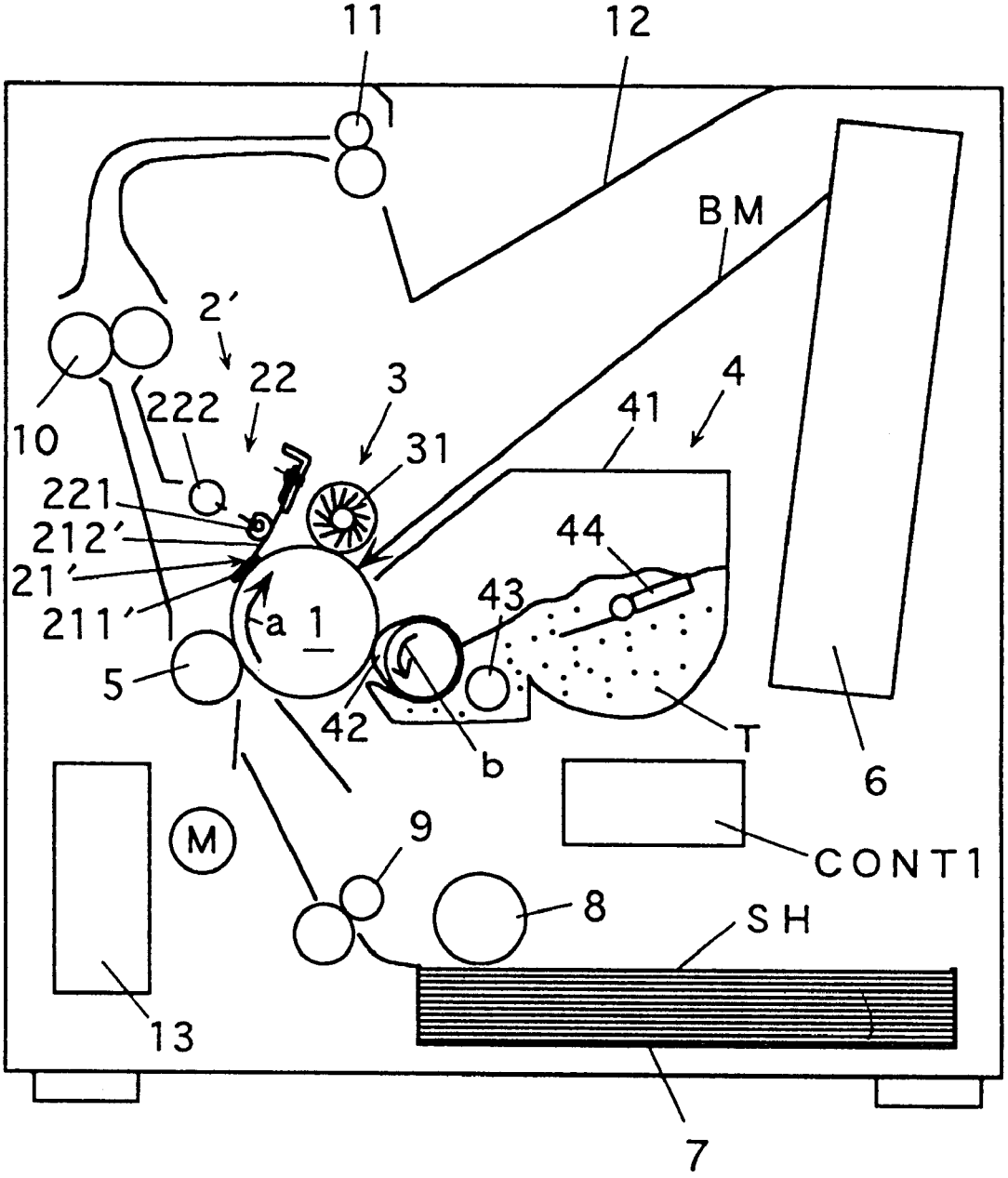
FIG. 1 shows a schematic structure of an example (printer) of an image forming apparatus of a first type according to the invention.

DESCRIPTION OF THE PREFERRED EMBODIMENTS (1) First Type of the Image Forming Apparatus The image forming apparatus of the first type includes at least one charging device opposed to the moving surface of the image carrier. At least one of said charging device includes a charging member to be supplied with a charging voltage and having a smooth surface opposed to said image carrier. The smooth surface of said charging member has a discharge contributing surface contributing to discharging to said image carrier. The apparatus further includes a charging member drive device for bringing said smooth surface having said discharge contributing surface into contact with the moving surface of said image carrier and relatively sliding said discharge contributing surface with respect to said image carrier surface.

In this image forming apparatus, the charging device may be either a contact charging device or a proximity charging device.

The contact charging device may have such a structure that the charging member has the smooth surface which is opposed to the image carrier surface and has a portion in contact with the image carrier surface, and the discharge contributing surface is formed at a portion of the smooth surface other than the contact portion spaced from the image carrier surface.

The proximity charging device may have such a structure that the charging member has the smooth surface opposed to the image carrier surface, and a portion of the smooth surface neighbors to the image carrier surface with a predetermined distance therebetween.

In either case, the charging member may have a sheet-like form or a roller form.

The charging member in the sheet-like form may be a member, which includes a charging portion directly contributing to the charging and a support portion supporting the charging portion, and has a sheet-like form as a form, as well as a blade-like member, a sheet-like member in its literal sense, a film-like member and others.

In the contact charging device employing the charging member in a sheet-like form, the charging member may be supported in a cantilever manner so that a portion of the charging member may be in contact with the image carrier.

In either the contact charging device or the proximity charging device, the maximum distance between the discharge contributing surface of the charging member, which is arranged at the position for discharging, and the image carrier surface may be set to exceed a distance causing discharging with a minimum discharge voltage according to Paschen's law.

The charging member in the sheet-like form may be a flexible sheet-like charging member having an elastic restoring property, in which case the charging member drive device may have a structure (1-A) including a cam device having a cam which can press the charging member against the image carrier to bring its discharge contributing surface into contact with the moving surface and can slide the discharge contributing surface relatively to the image carrier surface, utilizing the elastically restoring force of the charging member; a structure (1-B) having an electrostatic attraction force applying device which applies an electrostatic attraction force to the charging member toward the image carrier to bring the discharge contributing surface of the charging member into contact with the moving surface of the image carrier and slide the discharge contributing surface relatively to the image carrier surface; or a structure (1-C) including a solenoid-actuated drive device which acts on the charging member to bring the discharge contributing surface of the charging member into contact with the moving surface of the image carrier and slide the discharge contributing surface relatively to the image carrier surface.

In the contact charging device employing the charging member in the roller-like form, the charging member drive device may be adapted to drive and rotate the roller charging member at a peripheral speed different from the moving speed of the image carrier surface. In the proximity charging device employing the charging member in the roller form, the charging member drive device may include a drive for driving and rotating the roller charging member at a peripheral speed different from the moving speed of the image carrier surface, and a drive for moving the roller charging member toward or away from the image carrier.

In either case, the charging member drive device may have a structure (1-*a*) which drives the charging member such that the discharge contributing surface of the charging member may be repetitively brought into sliding contact with the image carrier surface while the surface of the image carrier is moving; a structure (1-*b*) which drives the charging member such that the discharge contributing surface of the charging member is brought into sliding contact with the surface of the image carrier in accordance with timing, other than that during image formation, such as timing of a pre-operation of the image carrier before the image formation, inter-image timing between image forming operations for a plurality of images or timing of a post-operation of the image carrier after the image formation, or a structure (1-*c*) which drives the charging member such that the discharge contributing surface is brought into sliding contact with the image carrier surface in accordance with timing of a predetermined operation, which is performed on the image forming apparatus, such as timing for opening and closing an outer cover of a main unit of the printer or timing of exchange of parts.

Specific examples of the image forming apparatus of the first type will be described below with reference to the drawings.

FIG. 1 shows an example of the image forming apparatus according to the invention, and more particularly shows a schematic structure of a laser beam printer performing reversal development.

This laser beam printer is provided at its substantially central portion with an organic photosensitive member 1 in a drum-like form, i.e., an image carrier having a cylindrical form and provided at its outer peripheral surface with a thin film layer made of an organic photoconductive material (OPC). The photosensitive member 1 is negatively chargeable, and is driven to rotate in a direction of an arrow a in the figure.

An auxiliary charging device 2', a main charging device 3, a developing/cleaning device 4 and a transfer roller 5 are successively aligned around the photosensitive member 1 in the rotating direction of the photosensitive member 1. An image exposure device 6 using a laser beam is arranged behind the developing/cleaning device 4.

A sheet cassette 7 is arranged under the developing/cleaning device 4. Transfer sheets SH in the sheet cassette 7 are fed therefrom by a sheet feed roller 8 in accordance with predetermined timing.

The transfer sheet SH fed from the sheet cassette 7 is transported to a timing roller pair 9 along a guide.

A fixing roller pair 10 is arranged above the transfer roller 5, and a sheet discharge roller pair 11 and a discharged sheet tray 11 follow the fixing roller pair 10.

A power source 13 is arranged at one side of a lower portion of the apparatus.

The main charging device 3 is formed of a charging brush roller 31, which is in contact with the photosensitive member 1. The charging brush roller 31 is driven to rotate and is supplied with a predetermined voltage from the power source 13 for charging the photosensitive member surface prior to image exposure for forming an electrostatic latent image which will be described later. The voltage supplied to the charging brush roller 31 may be a DC voltage of a constant value, or may be formed of a DC voltage superposed with an AC voltage.

Application of the alternating voltages in this manner can achieve more uniform charging of the photosensitive member surface than the case merely employing a DC voltage, and therefore can remarkably reduce irregularities in charging.

Although not restricted thereto, this embodiment uses DC voltages of −1350 V and −300 V which are alternately supplied by a switching operation of a switching element in the power source.

The photosensitive member 1 and other rotary members are driven to rotate by a motor M through transmission mechanisms which are not shown.

Figure 2:
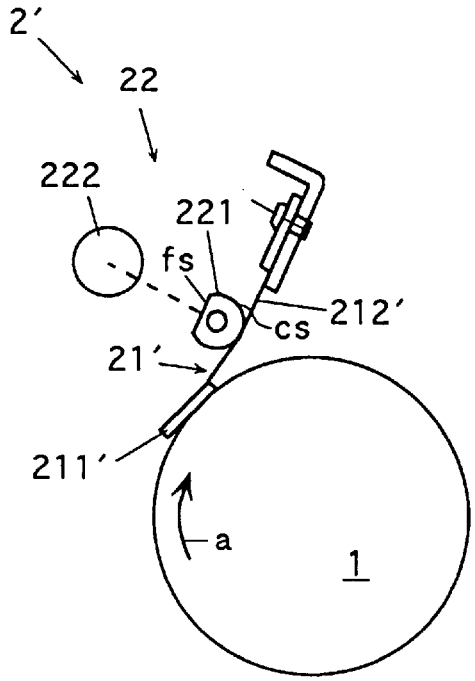
FIG. 2(A) is a side view showing, on an enlarged scale, an auxiliary charging device of the printer in FIG. 1 with its charging member located at a position.
FIG. 2(B) shows the same with its charging member located at another position.
Figure 2:
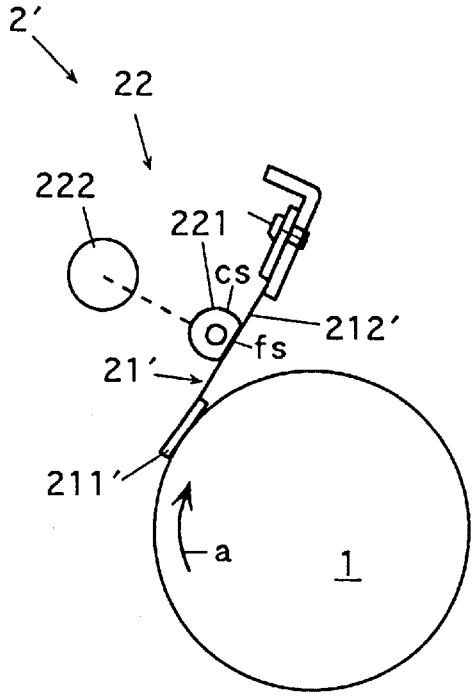

As also shown in FIG. 2, the auxiliary charging device 2' includes a flexible sheet-like charging member 21' having an elastic restoring property as a whole, and also includes a charging member drive device 22.

The sheet-like charging member 21' is formed of a belt-like charging portion 211' which is in contact with the surface of the photosensitive member 1 and a supporting portion 212' supporting the portion 211'. The support portion 212' is formed of a flexible plate spring having a high elastic restoring property. The support portion 212' is supported in a cantilever manner at its downstream end, in the moving direction a of the photosensitive member surface, on a fixed position, and supports at its upstream end the charging portion 211'. The charging portion 211' has a smooth surface 211*a*' (see FIG. 3) opposed to the photosensitive member 1 and having a portion which is in contact with the surface of the photosensitive member 1.

The charging member drive device 22 includes, as shown in FIGS. 1 and 2, a rotary cam 221 which is in contact with an upper surface of the support portion 212' of the charging member 21' and a mechanism 222 for moving the rotary cam 221 in accordance with rotation of the photosensitive member.

The cam 221 has a form which can be prepared by cutting off a portion of an outer peripheral surface of a member having a circular section in a direction parallel to a rotation axis of the cam to form a flat surface fs. The cam 221 can be driven to rotate in accordance with the rotation of the photosensitive member 1 so that its outer peripheral curved surface cs and the flat surface fs can alternately come into contact with the support portion 212'.

The support portion 212' is pushed downward to a position shown in FIGS. 2(A) and 3(A) by the cam 221 when its outer peripheral curved surface cs comes into contact with the support portion 212'. In the position shown in FIG. 3(A), a downstream portion P1', in the surface moving direction a of the photosensitive member 1, of the charging portion 211' is in contact with the photosensitive member. A discharge contributing surface S1', which performs discharging according to the Paschen's law and is spaced by a predetermined distance from the photosensitive member surface, is formed at a projecting portion which projects by a length L upstream from the portion P1'. When the cam 221 turns to a position where its flat surface fs comes into contact with the support portion 212', the support portion 212' elastically restores to a position shown in FIGS. 2(B) and 3(B). In the position shown in FIG. 3(B), an upstream portion P2', in the surface moving direction a of the photosensitive member 1, of the charging portion 211' is in contact with the photosensitive member. A discharge contributing surface S2' which performs discharging according to the Paschen's law and is spaced by a predetermined distance from the photosensitive member surface is formed at a projecting portion downstream to the portion P2'. Thus, in accordance with rotation of the cam 221, the discharge contributing surfaces S1' and S2' reciprocate in the moving direction of the photosensitive member surface. When the position changes from the position shown in FIG. 3(A) to the position shown in FIG. 3(B), the discharge contributing surface S1' slides on the photosensitive member surface and is rubbed thereby. When the position changes from the position shown in FIG. 3(B) to the position shown in FIG. 3(A), the discharge contributing surface S2' slides on the photosensitive member surface and is rubbed thereby. In this manner, smear by toner and others adhered to the discharge contributing surface is cleaned up.

The charging member 21' and, more specifically, the charging portion 211' is supplied with a DC voltage of, e.g., −1350 V from the power source 13, although not restricted thereto.

Figure 4:
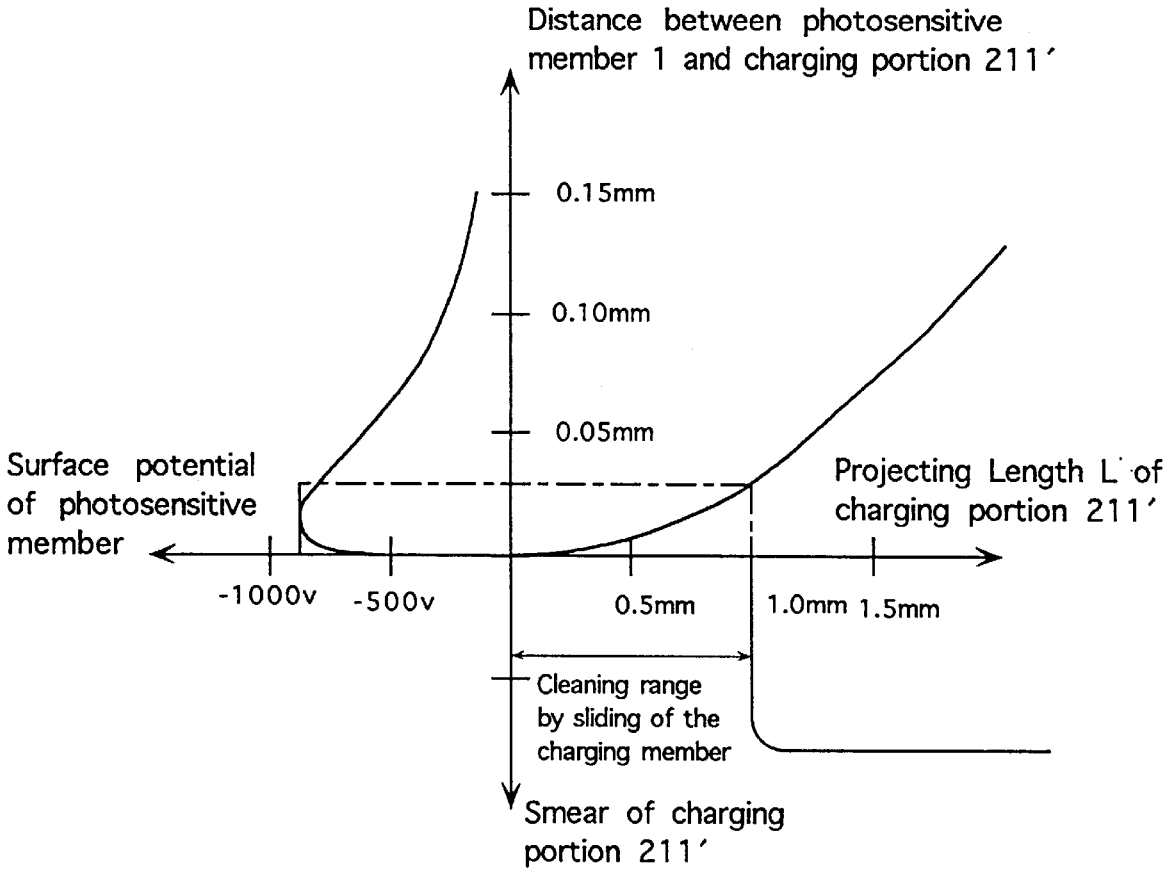
FIG. 4 shows a relationship between a position, at which smear is removed from a charging portion of a charging member of an auxiliary charging device, a distance which can be kept between a photosensitive member surface and the charging portion, and a surface potential of the photosensitive member when a constant voltage is applied to the charging member of the auxiliary charging device.

FIG. 4 shows a relationship between the cleaning position of the charging portion 211' during application of the DC voltage of −1350 V to the charging portion 211', and the distance kept thereby from the photosensitive member surface and the surface potential of the photosensitive member.

As can be seen from FIG. 4, the following advantage can be achieved by such a structure that the maximum space distance h1' (h2') between the discharge contributing surface S1' (S2') and the photosensitive member 1 is set to be equal to or larger than a distance which causes discharging with the minimum discharging voltage according to the Paschen's law. More specifically, even if there are irregularities in space distance between the discharge contributing surface S1' (S2') and the photosensitive member 1 in the direction of the rotation axis of the photosensitive member 1, discharging can be performed without a problem, and the uniform charging at a predetermined level can be performed without irregularities. In this embodiment, the space distance h1' (h2') is determined to attain the above advantage.

The purpose and function of the auxiliary charging device 2' will be described later.

The developing/cleaning device 4 includes a hopper 41 accommodating negatively chargeable toner T made of a non-magnetic one-component type. The developing device 4 includes a developing sleeve 42 which is driven to rotate in a direction of an arrow b in the figure and is opposed to the photosensitive member 1. In the hopper behind the sleeve 42, there are arranged a rotary member 43 for supplying the toner T to the developing sleeve 42 and agitating blades 44 for supplying the toner and preventing solidification.

The developing sleeve 42 is supplied with a bias voltage in a range from −100 V to −500 V (−300 V supplied from the power source 13 in this embodiment) so as to generate an electric field for transporting the toner T, which has the electric charges of the same polarity as the chargeable polarity of the photosensitive member 1, to the photosensitive member 1 and, in other words, for moving the toner T from the developing sleeve 42 to the laser-irradiated portion (exposed portion) on the photosensitive member 1. The rotary members in the developing/cleaning device 4 are driven to rotate by the drive device (not shown).

The transfer roller 5 is supplied with a transfer voltage from the power source 13. The transfer voltage has a polarity opposite to that of the toner, and is in a range from +1 kV to +5 kV, although not restricted thereto. Owing to application of the transfer voltage, the visible toner image on the photosensitive member is electrostatically attracted and transferred onto the transfer sheer SH transported to a position between the transfer roller 5 and the photosensitive member 1.

The laser device 6 radiates laser beams BM corresponding to the image information to the surface portion of the photosensitive member 1 located between the charging brush 31 and developing/cleaning device 4, and thereby forms a potential reduced portion at the photosensitive member surface, which was uniformly charged by the charging brush 31, to form an electrostatic latent image.

According to the laser beam printer described above, the photosensitive member 1 is driven to rotate for the image formation, and the surface of the photosensitive member 1 is uniformly charged by the charging brush roller 31 while being affected by the charging by the auxiliary charging device 2' so that the potential thereon attains nearly −800 V in this embodiment. The charged region is subjected to the exposure based on the image information by the laser device 6 so that the electrostatic latent image is formed. This electrostatic latent image is developed by the developing/cleaning device 4 into the visible image. During the above operations, the feed roller 8 feeds the transfer sheet SH from the sheet cassette 7 to the timing roller pair 9, which transfers, in synchronization with the toner image on the photosensitive member 1, the sheet SH to the transfer portion between the transfer roller 5 and the photosensitive member 1. In this manner, the transfer roller 5 transfers the visible toner image onto the transfer sheet SH. Then, the transfer sheet SH passes through the fixing roller pair 10 to fix the toner image, and then is discharged onto the discharged sheet tray 12 by the sheet discharge roller pair 11.

After the transfer, the untransferred residual toner remaining on the photosensitive member 1 contains toner which is charged positively, i.e., to the polarity opposite to the normally charged polarity due to an influence by the application of the positive voltage from the transfer roller 5 during transferring and an influence by paper powder and others. If the positively charged toner were sent to the charging brush roller 31, it would adhere to the roller 31 supplied with the negative voltage, in which case charging of the photosensitive member 1 would be adversely affected, resulting in problems such as black stripes or coarse images in halftone images.

In this embodiment, however, the untransferred residual toner first reaches the auxiliary charging device 2' in accordance with rotation of the photosensitive member 1.

The charging member 21' of the auxiliary charging device 2' is supplied with the DC voltage of −1350 V as already described, and charges both the photosensitive member surface and the untransferred residual toner passing therethrough to about −900 V in this embodiment. In this manner, the untransferred residual toner charged to the opposite polarity is charged to attain the intended polarity, i.e., negative polarity, and therefore is prevented from adhesion to the charging brush roller 31 which the toner will reach. Thereby, the brush roller 31 can charge the photosensitive member without a difficulty.

Also, the charging brush roller 31 disperses the untransferred residual toner so that so-called exposure eclipse during the exposure by the laser device 6 can be suppressed.

When new image formation is not performed subsequently, the untransferred residual toner moves to the developing/cleaning device 4. If new image formation is to be performed subsequently, the laser device 6 radiates the laser beam BM corresponding to the next image information to the surface of the photosensitive member 1 carrying dispersed residual toner. The potential of the portion, which is irradiated with the laser, and will be referred to as an image portion hereinafter, is lowered with respect to a portion, which is not irradiated with the laser, and will be referred to as a non-image portion, so that a new electrostatic latent image is formed.

The new electrostatic latent image thus formed moves to a position of the developing sleeve 42 of the developing/cleaning device 4 in accordance with rotation of the photosensitive member 1, and is developed with the developing bias. Simultaneously with the developing, the untransferred residual toner T located at the non-image portion is electrostatically attracted and collected by the developing sleeve 42 owing to the difference between the potential of the non-image portion and the developing bias potential.

As described above, the untransferred residual toner is collected to the developing sleeve 42. In the actual operation, however, the untransferred residual toner or the like adheres to and thereby smears the discharge contributing surface of the charging portion 211' of the charging member 21' in the auxiliary charging device 2'. This is due to the fact that the untransferred residual toner, which is positively charged due to an influence by the transfer voltage during the transfer operation and others, is attracted to the charging portion 211' by a Coulomb force. When smeared, the charging portion 211' performs irregular charging so that portions of the charging brush roller 31 corresponding to the portions performing undesired discharging are smeared, resulting in image noises.

Figure 3:
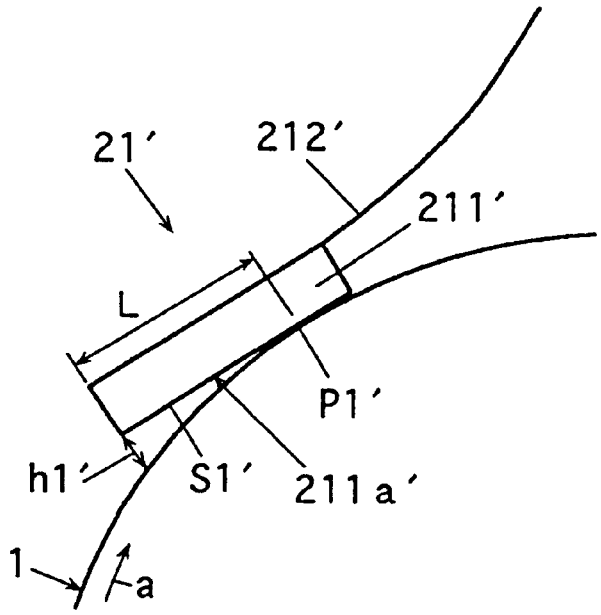
FIG. 3(A) shows, on an enlarged scale, a portion in FIG. 2(A)
FIG. 3(B) shows, on an enlarged scale, a portion in FIG. 2(B)
Figure 3:
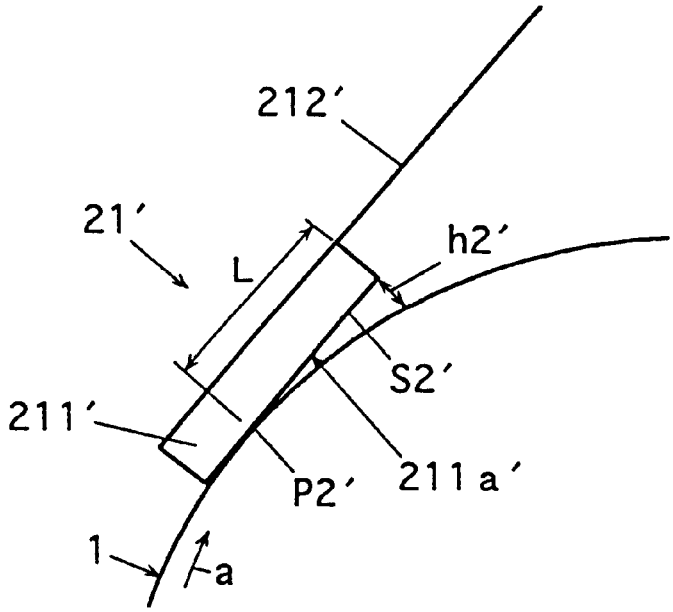

In this embodiment, the auxiliary charging device 2' is provided with the charging member drive device 22, which reciprocates the charging portion 211' along the surface moving direction of the photosensitive member in accordance with rotation of the photosensitive member as already described with reference to FIG. 3. Thereby, the discharge contributing surfaces S1' and S2' can slide on the photosensitive member surface to remove the smear thereon so that image noises can be suppressed.

In the above description, the charging member 21' slides on the photosensitive member in accordance with rotation of the photosensitive member. Alternatively, driving of the charging member may be performed in accordance with timing, other than that during image formation, such as timing of a pre-rotation of the photosensitive member before the image formation, inter-image timing between image forming operations for a plurality of images, or timing of a post-rotation of the photosensitive member after the image formation, or may be performed in accordance with timing of a predetermined operation performed on the printer such as an operation opening or closing an outer cover of a main unit of the printer, or timing of exchange of parts of the printer.

Movement may be performed nonperiodically but within a period causing smear of the charging member 21' only to an allowable extent.

The cleaning in accordance with the above timing can be performed, for example, by operating the charging member drive device 22 under the control by a controller CONT1 which controls the operation of the whole printer.

Then, another example of the image forming apparatus according to the invention will be described below with reference to FIG. 5.

Figure 5:
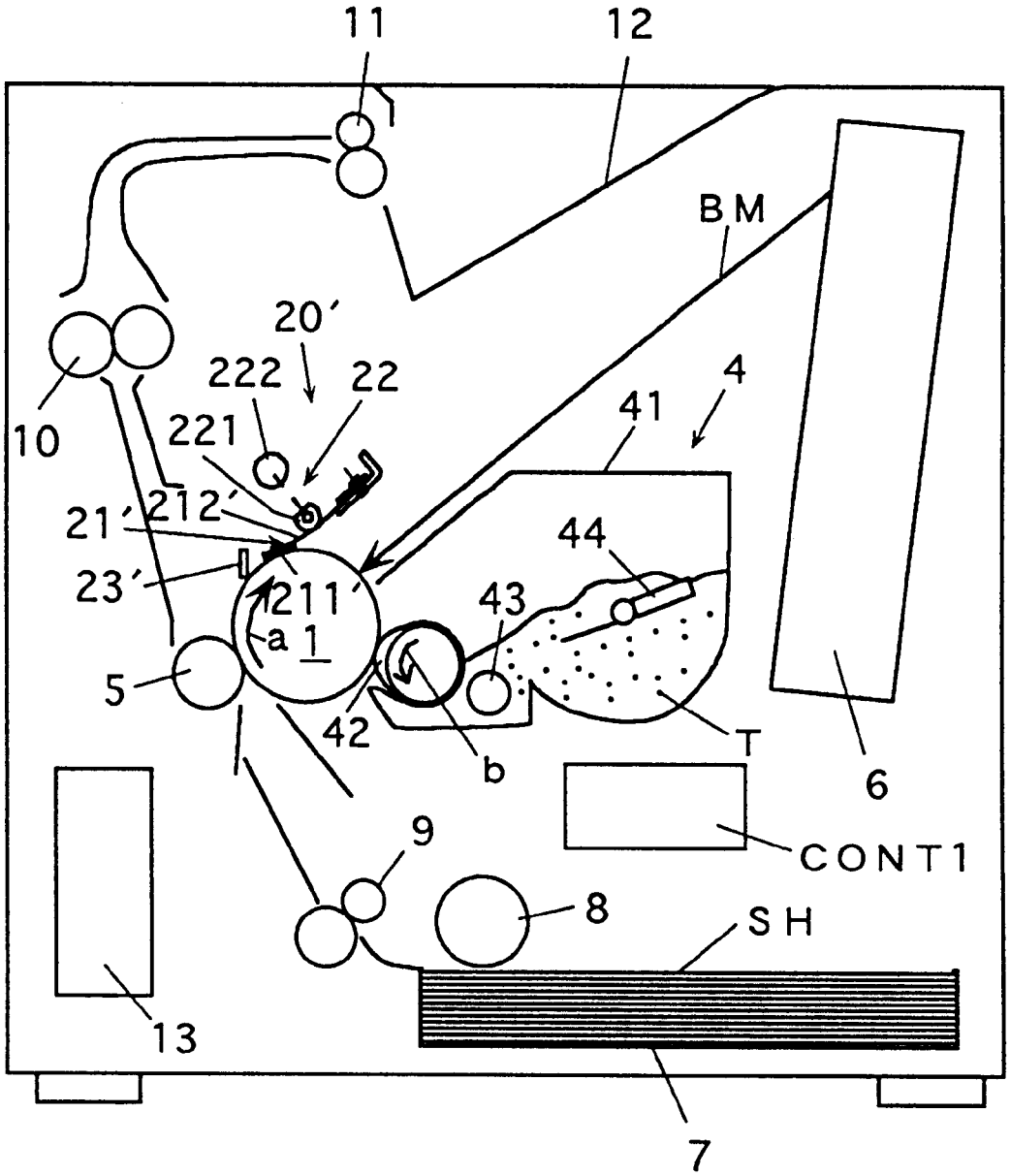
FIG. 5 shows a schematic structure of another example (printer) of an image forming apparatus of the first type according to the invention.

The image forming apparatus shown in FIG. 5 is likewise a laser beam printer, and differs from the printer shown in FIG. 1 in that the auxiliary charging device 2' is replaced with a charging device 20', and the charging device 3 in the printer shown in FIG. 1 is removed. Structures other than the above are the same as those in the printer shown in FIG. 1, and the same parts and portions bear the same reference numbers.

The charging device 20' is similar to the auxiliary charging device 2' shown in FIG. 1 and is additionally provided with a cleaner blade 23' which is located upstream to the charging member 21' and is in contact with the photosensitive member 1.

Since the charging device 20' is provided with the cleaner blade 23', the charging member 21' is smeared less than the auxiliary charging device 2' shown in FIG. 1. Accordingly, smearing of the charging member 21' can be sufficiently removed by reciprocating the charging member 21' similarly to the device 2', and thereby the photosensitive member 1 can be charged to an intended potential only by the charging member 21'. Thus, the charging device 3 can be removed.

Figure 6:
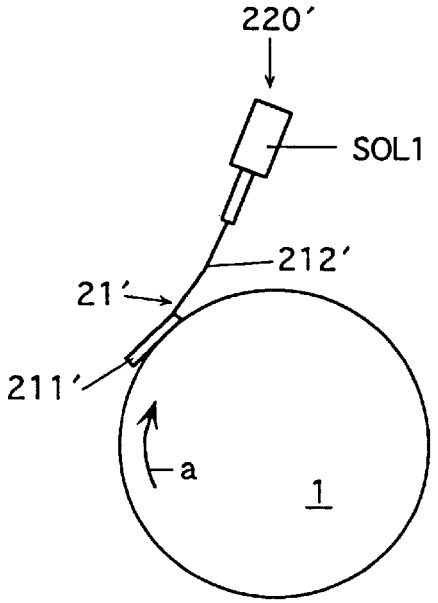
FIGS. 6 to 9 shows other different examples of the auxiliary charging device, respectively.
Figure 7:
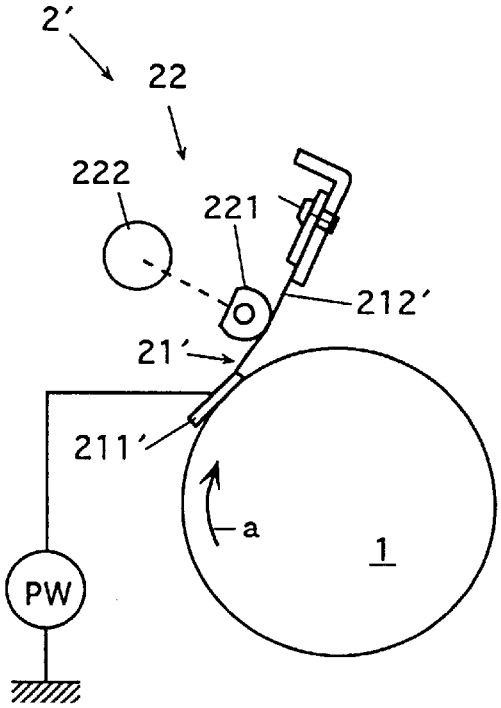

Each of the charging devices 2' and 20' employs the cam mechanism for driving the charging member 21'. Alternatively, as shown in FIG. 6, a drive device 220' including a solenoid SOL1 may be employed for reciprocation of the charging member 21'. Also, as shown in FIG. 7, such a structure may be employed that an AC power source PW applies an AC voltage to the charging member 21' in the charging device 2' for changing the electrostatic attraction force toward the photosensitive member 1 in accordance with the periods of voltage application so that the charging member 21' vibrates and the smear is removed also by this vibration. In this case, however, the charging portion 211' is formed of a sheet made of a semiconductive material of, e.g., $10^4$ Ωcm–$10^9$ Ωcm such as a styrene elastomer and carbon particles dispersed therein. In this case, the cam mechanism may be eliminated.

Figure 8:
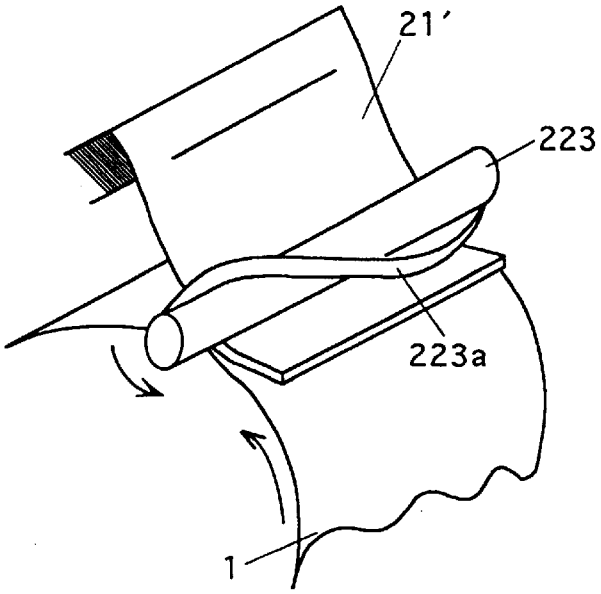

Further, as shown in FIG. 8, the cam 221 in the charging device 2' shown in FIG. 1 may be replaced with a rotary cam 223 of a screw type provided with a spiral blade. The cam 223 operates to push a portion of the charging member 21' while successively changing the position of the pushed portion of the member 21' from its one end toward the other end, and then returning the position to the one end. The spiral blade 223*a* of the rotary cam 223 is designed such that the force for pushing the charging member 21' against the photosensitive member 1 can be uniform independently of the position in the direction of the rotation axis of the photosensitive member and, in other words, the cam can push the charging member by a uniform length. In this embodiment, therefore, the spiral blade 223*a* is designed such that the pushed length of the central portion of the charging member 21' is substantially equal to the pushed lengths of the ends of the charging member 21' and, for this purpose, the sum of pushed lengths at the opposite ends is substantially equal to the pushed length at the central portion.

According to the cam 221 shown in FIG. 1, the pressure of the charging member 21' against the photosensitive member 1 is liable to vary at various positions spaced from each other in the rotation axis direction of the photosensitive member in accordance with rotation of the cam, and a large variation in load against the photosensitive member 1 is liable to occur. In contrast to this, the rotary cam 223 can provide a uniform pressing force of the charging member 21' against the photosensitive member 1 at various positions spaced in the rotation axis direction of the photosensitive member, and thereby can reduce a variation in load against the photosensitive member 1.

In this embodiment, the rotary cam 223 has the spiral blade. Alternatively, a member other than the cam 223 provided that the force pushing the charging member can be uniform independently of the position.

Figure 9:
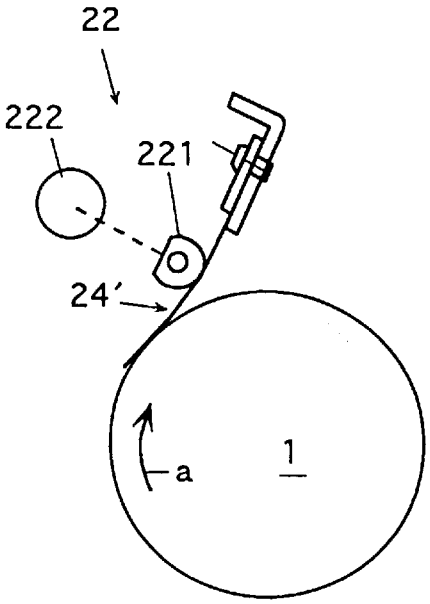

In any of the cases employing the foregoing charging devices, a sheet-like charging member may be employed instead of the charging member 21' and, for example, a charging member 24' having a film-like form exemplified in FIG. 9 may be employed.

Instead of the charging members 21' and 24' as well as various kinds of charging member drive devices described above, a charging roller which is in contact with the surface of the photosensitive member 1 may be employed. This charging roller is driven by an appropriate device to rotate at a speed different from the moving speed of the photosensitive member surface so that the smear on the surface of the charging roller can be cleaned up.

Each of the image forming apparatuses already described employs the structure for removing smear from one charging device. If necessary, structures for removing smear may be employed for two or more charging devices, respectively.

The charging devices 2' and 20' and others for cleaning up the charging members already described are of a contact type. However, the invention can be applied to the charging device of a proximity type, in which case various charging members and drive devices for the same may be employed.

(2) Second Type of the Image Forming Apparatus

The second type of the image forming apparatus is an electrophotographic image forming apparatus of a cleanerless type. A plurality of contact members are in contact with a surface of an image carrier. One of the plurality of the contact members has a contact surface being in contact with the image carrier surface and shaving the image carrier surface to the highest extent. The contact surface has a high smoothness compared with the other of the plurality of the contact members.

In this image forming apparatus, the contact member which shaves the image carrier surface to the highest extent may be a dedicated contact member for shaving the image carrier surface or may be, for example, an auxiliary charging member which is arranged in a section defined, in the moving direction of the image carrier surface, between a transfer portion where a visible image is transferred onto a transfer target member and a main charging device for charging the image carrier surface. This member can serve also as an auxiliary charging member for charging untransferred residual toner, which is charged to the polarity opposite to that of the voltage applied to the main charging device, to the same polarity as that of the voltage application to the main charging device.

The image carrier may be typically an organic photosensitive member, although not restricted thereto.

The surface of the contact member, which shaves the image carrier surface to the highest extent and is in contact with the image carrier surface, may have a roughness which is about 5 μm or less in Rz for suppressing the surface roughness of the image carrier to a level not causing reduction in image density, but is not lower than about 1 μm in Rz for achieving the shaving to an extent allowing removal of the discharge product adhering onto the image carrier and the toner in a film form, although not restricted thereto.

When the image carrier surface is shaved with use of the image forming apparatus, a difference in surface roughness between minute surface portions spaced by 30 μm from each other, in the image carrier surface direction, at various positions of the image carrier may be typically set to 0.6 μm or less, although not restricted thereto. A smaller value of this difference is more preferable in view of suppressing the irregular reflection during the image exposure.

Also, when the image carrier surface is shaved with use of the image forming apparatus, the surface roughness of the image carrier may be 200 μm or more in Sm, and may be 3 μm or less in Rz.

In any of the above cases, the contact member which shaves the image carrier surface to the highest extent may attain such a state that foreign matters such as paper powder, special coating material applied to the surface of the transfer paper and/or adhesive are held at a portion of the contact member which first comes into contact with the image carrier. If this state continues, this state causes shaving of the image carrier surface in a striped form so that striped image noises are liable to appear. Therefore, a member drive device may be employed for rapidly passing the foreign matters through a position between the contact member and the image carrier. This member drive device can move (e.g., reciprocate) the contact member, which shaves the image carrier surface to the highest extent, along the surface of the image carrier surface. Owing to movement of the contact member by this member drive device, the foreign matter rapidly passes through a position between the contact member and the image carrier without being held therebetween.

In this case, the member drive device preferably has such a structure that can reciprocate the contact member, which shaves the image carrier surface to the highest extent, through a distance larger than a contact nip width between the contact member and the image carrier for allowing rapid and reliable passage of the foreign matters.

The contact member which shaves the image carrier surface to the highest extent may be a blade-like member, although not restricted thereto.

The blade-like member may have a blade-like form as a whole, and specifically may have a blade portion contributing directly to the shaving of the image carrier surface and a support portion supporting the blade portion. Alternatively, the blade-like member may have a blade-like form in the literal sense, a sheet-like form, a film-like form or the like.

If the blade-like member is employed as the contact member shaving the image carrier surface to the highest extent, the blade-like member may be a flexible blade-like member having an elastic restoring property. In this case, the member drive device may have, for example, a structure (2-A) including a cam device having a cam which applies and releases a pressing force against the blade-like member and thereby can reciprocate the blade-like member along the image carrier surface by utilizing the elastic restoring force of the blade-like member, a structure (2-B) including an electrostatic attraction force applying device which applies and releases an electrostatic attraction force against the blade-like member and thereby can reciprocate the blade-like member along the image carrier surface by utilizing the elastic restoring force of the blade-like member; or a structure (2-*c*) including a solenoid-actuated drive device which acts on the blade-like member to reciprocate the blade-like member along the image carrier surface.

In any of the cases, the member drive device may have a structure (2-*a*) which repetitively reciprocates the contact member, which shaves the image carrier surface to the highest extent, while the surface of the image carrier is moving; a structure (2-*b*) which reciprocates the contact member, which shaves the image carrier surface to the highest extent, in accordance with timing, other than that during image formation, such as timing of a pre-operation of the image carrier before the image formation, inter-image timing between image forming operations for a plurality of images or timing of a post-operation of the image carrier after the image formation, or a structure (2-*c*) which reciprocates the contact member, which shaves the image carrier surface to the highest extent, in accordance with timing of a predetermined operation, which is performed on the image forming apparatus, such as timing for opening and closing an outer cover of the main unit of the printer or timing of exchange of parts of the printer.

A specific example of the second type of the image forming apparatus will be described below with reference to the drawings.

Figure 10:
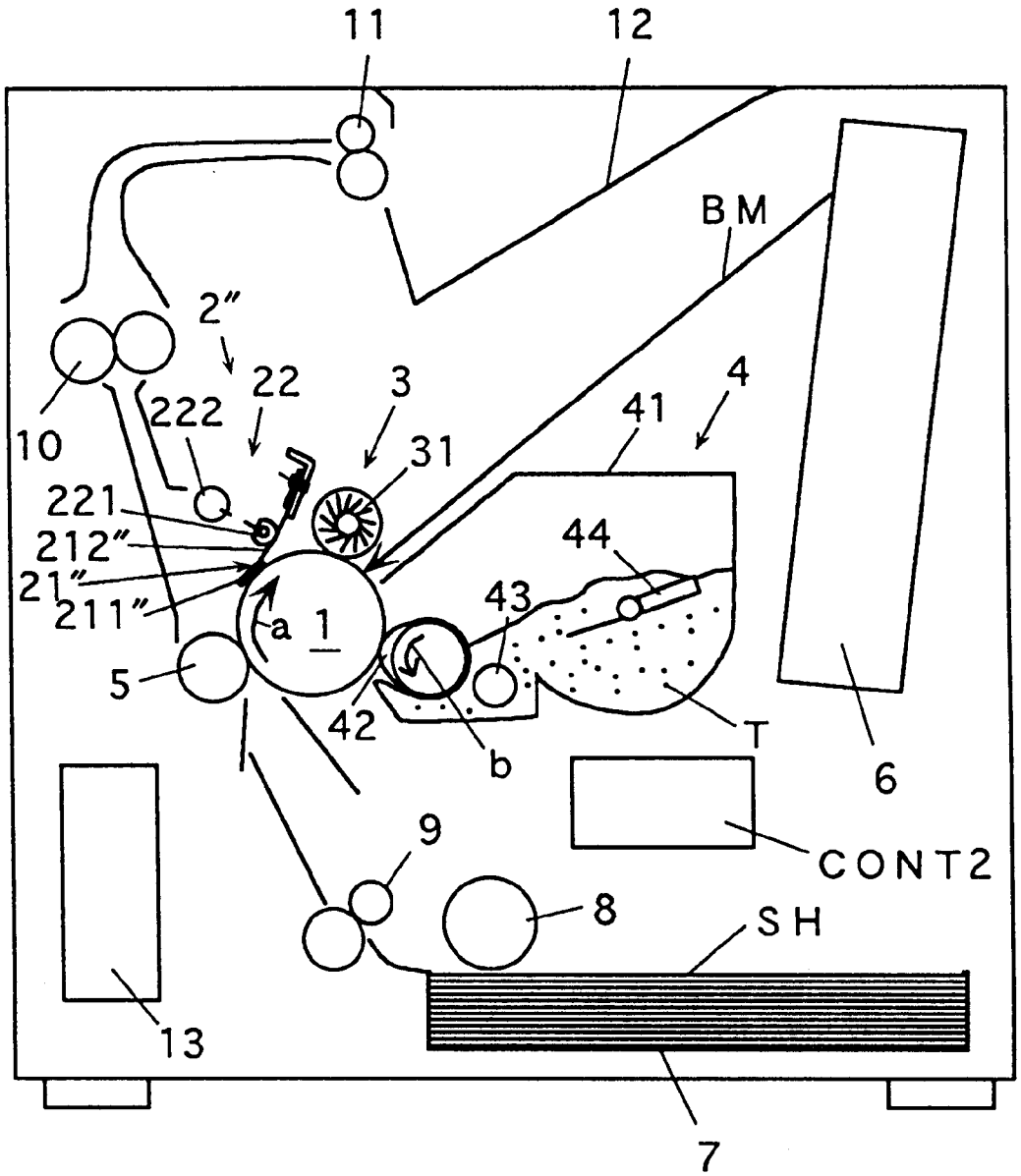
FIG. 10 is a schematic structure of an example (printer) of an image forming apparatus of a second type according to the invention.

FIG. 10 shows a schematic structure of the laser beam printer performing the reversal development.

This laser beam printer employs an auxiliary charging device 2" instead of the auxiliary charging device 2' in the printer shown in FIG. 1. Structures other than the above are the substantially same as the printer shown in FIG. 1. Parts, portions and others having the same structures or functions as those in the printer shown in FIG. 1 bear the same reference numbers.

Figure 11:
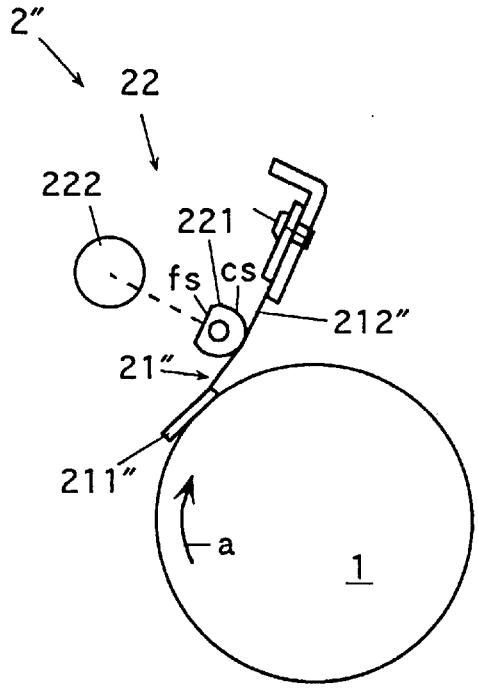
FIG. 11(A) is a side view showing, on an enlarged scale, an auxiliary charging device of the printer in FIG. 10 with its charging member located at a position.
FIG. 11(B) shows the same with its charging member located at another position.
Figure 11:
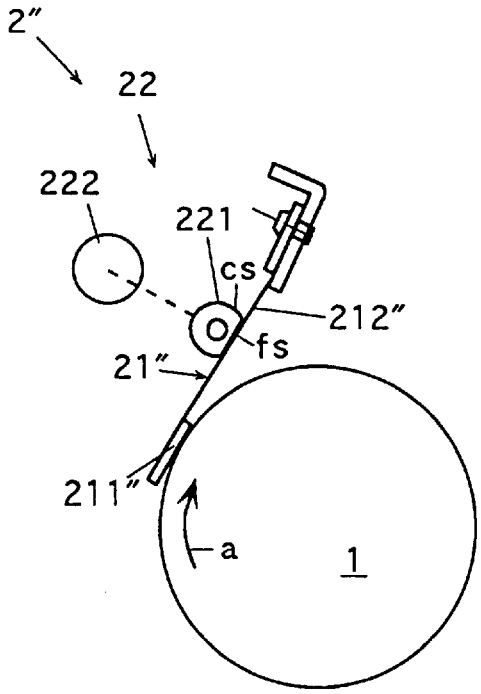

The auxiliary charging device 2" includes, as shown in FIGS. 11(A) and 11(B), a blade-like charging member 21" having a restoring property as a whole and the charging member drive device 22.

The blade-like charging member 21" is formed of a belt-like blade portion 211" which is in contact with the surface of the photosensitive member 1 and a supporting portion 212" supporting the portion 211". The supporting portion 212" is formed of a flexible plate spring having a high elastic restoring property. The supporting portion 212" is supported in a cantilever manner at its downstream end, in the moving direction a of the photosensitive member surface, on a fixed position, and supports at its upstream end the blade portion 211". The blade portion 211" has a smooth surface 211*a*" (see FIG. 12(A)) opposed to the photosensitive member 1 and having a portion which is in contact with the surface of the photosensitive member 1.

The blade portion 211" is made of styrene elastomer and carbon particles dispersed therein, and has a resistance value of $10^4$ Ωcm–$10^9$ Ωcm. The blade portion 211" can shave the photosensitive member surface to the highest extent compared with various members in contact with the photosensitive member 1. The blade portion 211" has a surface 211*a*" which is opposed to the photosensitive member 1 and has surface roughnesses at various positions which are within a range from 1 μm to 5 μm in Rz.

The charging member drive device 22 employs a cam mechanism having the substantially same cam mechanism as the charging member drive device 22 shown in FIG. 1 and others. Parts and portions having the same structures and functions as those in the drive device 22 shown in FIG. 1 bear the same reference numbers.

Figure 12:
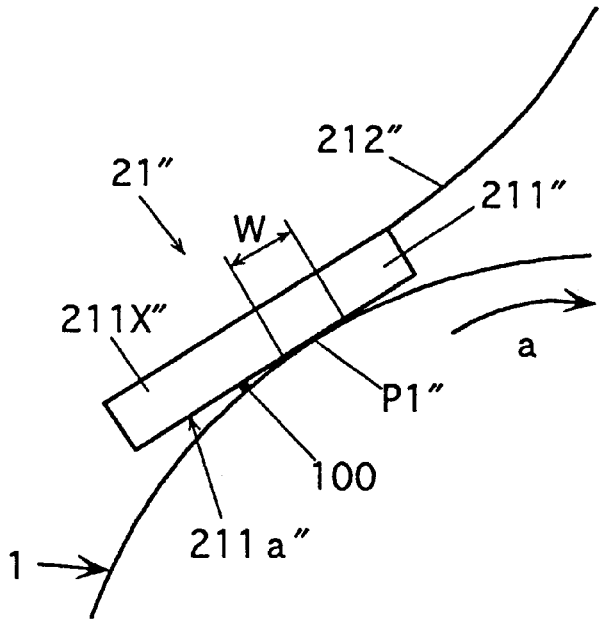
FIG. 12(A) shows, on an enlarged scale, a portion in FIG. 11(A)
FIG. 12(B) shows, on an enlarged scale, a portion in FIG. 11(B)
Figure 12:
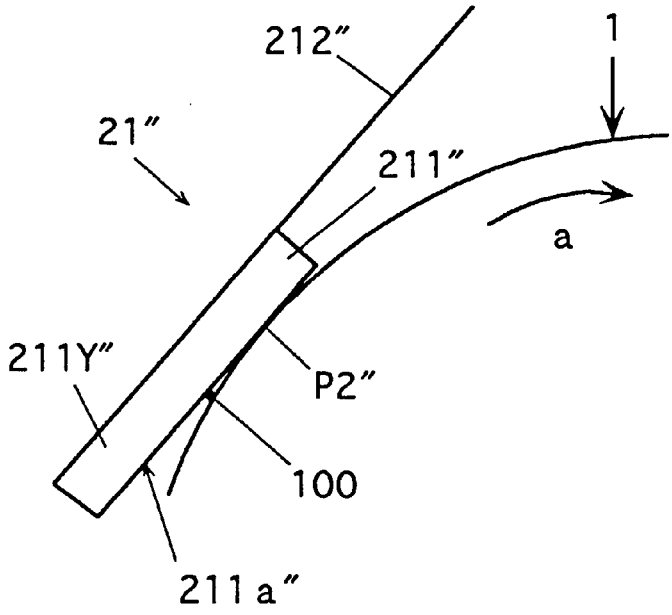

The support portion 212" is pushed downward to a position shown in FIGS. 11(A) and 12(A) by the cam 221 when its outer peripheral curved surface cs comes into contact with the support portion 212". In the position shown in FIG. 12(A), a downstream portion P1", in the surface moving direction a of the photosensitive member 1, of the charging portion 211" is in contact with the photosensitive member. An upstream projecting portion 211*x*" is spaced from the photosensitive member surface. When the cam 221 turns to a position where its flat surface fs comes into contact with the support portion 212", the support portion 212" elastically restores to a position shown in FIGS. 11(B) and 12(B). In the position shown in FIG. 12(B), the blade portion 211" is in contact with the photosensitive member through its downstream portion P2" downstream, in the surface moving direction a of the photosensitive member 1, to the portion P1", and a projecting portion 211Y" upstream to the portion P2" is spaced from the photosensitive member surface. A projecting length of the portion 211Y" is larger than that of the portion 211X".

When the cam 221 rotates, the blade-like charging member 21" and more specifically the blade portion 211" reciprocates along the surface of the photosensitive member surface so that a length of the portion thereof projected from the portion in contact with the photosensitive member varies. A pressure of the blade portion 211" against the photosensitive member 1 also varies. In the state shown in FIG. 12(B), the pressure is reduced.

In this embodiment, the distance which the blade portion 211" moves in one direction is equal to or larger than the contact nip width W between the photosensitive member 1 and the blade portion 211" pressed against the same as shown in FIG. 12(A).

The charging member 21" and more specifically the blade portion 211" is supplied with a DC voltage of −1350 V from the power source 13 in this embodiment, although not restricted thereto.

The purpose or function of the auxiliary charging device 2" will be described later.

The developing/cleaning device 4 is the same as the developing/cleaning device 4 shown in FIG. 1, and the parts and portions having the same structures or functions as those in the developing/cleaning device 4 in FIG. 1 bear the same reference numbers.

In the developing device, the developing sleeve 42 is likewise supplied with a bias voltage in a range from −100 V to −500 V (−300 V supplied from the power source 13 in this embodiment) so as to generate an electric field for transporting the toner T, which has the electric charges of the same polarity as the chargeable polarity of the photosensitive member 1, to the photosensitive member 1 and, in other words, for moving the toner T from the developing sleeve 42 to the laser-irradiated portion (exposed portion) on the photosensitive member 1.

The transfer roller 5 is supplied with a transfer voltage from the power source 13. The transfer voltage has a polarity opposite to that of the toner, and is in a range from +1 kV to +5 kV, although not restricted thereto. Owing to application of the transfer voltage, the visible toner image on the photosensitive member is electrostatically attracted and transferred onto the transfer sheet SH transported to a position between the transfer roller 5 and the photosensitive member 1.

The laser device 6 is the same as the laser device 6 shown in FIG. 1.

According to the laser beam printer described above, the photosensitive member 1 is driven to rotate for the image formation, and the surface of the photosensitive member 1 is uniformly charged by the charging brush roller 31 while being affected by the charging by the auxiliary charging device 2" so that the potential thereon attains nearly −800 V in this embodiment. The charged region is subjected to the exposure based on the image information by the laser device 6 so that the electrostatic latent image is formed. This electrostatic latent image is developed by the developing/cleaning device 4 into the visible image. During the above operations, the feed roller 8 feeds the transfer sheet SH from the sheet cassette 7 to the timing roller pair 9, which transfers, in synchronization with the toner image on the photosensitive member 1, the sheet SH to the transfer portion between the transfer roller 5 and the photosensitive member 1. In this manner, the transfer roller 5 transfers the visible toner image onto the transfer sheet SH. Then, the transfer sheet SH passes through the fixing roller pair 10 to fix the toner image, and then is discharged onto the discharged sheet tray 12 by the sheet discharge roller pair 11.

After the transfer, the untransferred residual toner remaining on the photosensitive member 1 contains toner which is charged positively, i.e., to the polarity opposite to the normally charged polarity due to an influence by the application of the positive voltage from the transfer roller 5 during transferring and other influence. If the positively charged toner were sent to the charging brush roller 31, it would adhere to the roller 31 carrying the negative voltage, in which case charging of the photosensitive member 1 would be adversely affected, resulting in problems such as black stripes or coarse images in halftone images.

In this embodiment, however, the untransferred residual toner first reaches the auxiliary charging device 2" in accordance with rotation of the photosensitive member 1.

The charging member 21" of the auxiliary charging device 2" is supplied with the DC voltage of −1350 V as already described, and charges both the photosensitive member surface and the untransferred residual toner passing therethrough to about −900 V in this embodiment. In this manner, the untransferred residual toner charged to the opposite polarity is charged to attain the intended polarity, i.e., negative polarity, and therefore is prevented from adhesion to the charging brush roller 31 which the toner will reach. Thereby, the brush roller 31 can charge the photosensitive member without a difficulty.

Also, the charging brush roller 31 disperses the untransferred residual toner so that so-called exposure eclipse during the exposure by the laser device 6 can be suppressed.

When new image formation is not performed subsequently, the untransferred residual toner moves to the developing/cleaning device 4. If new image formation is to be performed subsequently, the laser device 6 radiates the laser beam BM corresponding to the next image information to the surface of the photosensitive member 1 carrying dispersed residual toner. The potential of the portion, which is irradiated with the laser, and will be referred to as the image portion, is lowered with respect to a portion, which is not irradiated with the laser, and will be referred to as the non-image portion, so that a new electrostatic latent image is formed.

The new electrostatic latent image thus formed moves to a position of the developing sleeve 42 of the developing/cleaning device 4 in accordance with rotation of the photosensitive member 1, and is developed with the developing bias. Simultaneously with the developing, the untransferred residual toner T located at the non-image portion is electrostatically attracted and collected by the developing sleeve 42 owing to the difference between the potential of the non-image portion and the developing bias potential.

The toner or the like, which is charged to the opposite polarity and is attracted to the blade portion 211" by a Coulomb force, smears the blade portion 211". This smear is removed in such a manner that the charging member drive device 22 reciprocates the blade portion 211" in the surface moving direction of the photosensitive member in accordance with rotation of the photosensitive member as already described with reference to FIGS. 12(A) and 12(B), and thereby slides the blade portion 211" on the photosensitive member surface. Thereby, image noises which may be caused by smear on the discharge contributing surface can be suppressed.

The surface of the photosensitive member 1 is shaved by various members in contact with the same. As a whole, the photosensitive member surface is shaved in a direction corresponding to the surface roughness of the contact member among them shaving the photosensitive member surface to the highest extent, i.e., the smooth surface 211*a* of the blade portion 211" of the charging member 21" of the auxiliary charging device 2".

As a result, the surface of the photosensitive member 1 is uniformly shaved to such an extent that an adherent discharge product, toner film or the like on the photosensitive member surface are removed. Also, the surface roughness of the photosensitive member 1 is suppressed to an extent which does not cause significant irregular reflection of a light beam during the image exposure and thereby does not cause reduction in image density. In this manner, various portions of the photosensitive member surface can be shaved to a uniform extent, and thereby can prevent irregularities in image density. Also, the surface roughness of the photosensitive member 1 can be kept at a level which does not cause reduction in image density, which may be caused by irregular reflection of the photosensitive member surface.

Such a state may be attained that the foreign matters 100 (see FIGS. 12(A) and 12(B)) such as paper powder, special coating material applied to the surface of the transfer paper and/or adhesive are held a portion of the blade portion 211" of the charging member 21" which first comes into contact with the photosensitive member 1 in each contact operation. If this state continues, this state causes shaving of the surface of the photosensitive member 1 in a striped form so that striped image noises are liable to appear. In this embodiment, the charging member drive device 22 can reciprocate the blade portion 211" as shown in FIGS. 12(A) and 12(B). Therefore, the foreign matters can be sent to and are passed rapidly through a position between the blade portion 211" and the photosensitive member 1. Also, the blade portion 211" is reciprocated through a distance larger than the contact nip width W between the blade portion 211" and the photosensitive member 1 for allowing rapid and reliable passage of the foreign matters 100.

Figure 15:
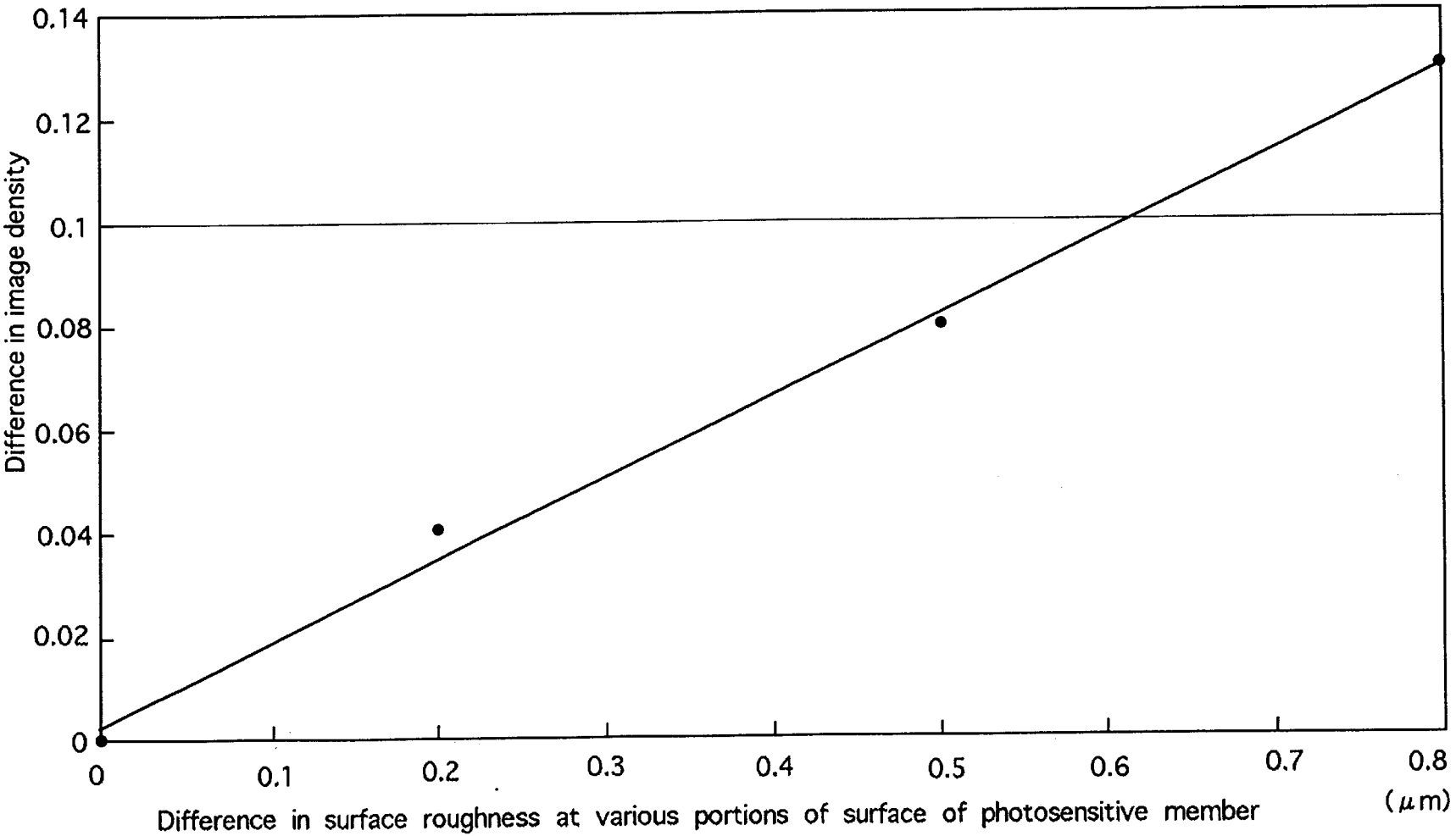
FIG. 15 is a graph showing an example of a relationship between differences in surface roughness among various portions of a photosensitive member surface and differences in image density caused by the differences in roughness.

FIG. 15 is a graph showing an example of a relationship between a difference in surface roughness at various portions of the surface of the photosensitive member 1 and a difference in image density caused thereby. It can be seen from this graph that the irregularities in image density can be suppressed to a practically allowable extent if the difference in surface roughness of the photosensitive member 1 is reduced to 0.6 $\mu$m or less.

As already described, the surface 211*a*" of the blade portion 211" of the charging member 21" which is in contact with the photosensitive member 1 has the surface roughness of 5 $\mu$m or less. The surface roughness of the surface 211*a*" of the blade portion 211" may be set such that a difference in roughness of the photosensitive member surface, which caused by shaving due to use of the printer, is preferably set substantially to 0.6 $\mu$m or less.

In the above description, the charging member 21" slides on the photosensitive member in accordance with rotation of the photosensitive member. Alternatively, driving of the charging member may be performed in accordance with timing, other than that during image formation, such as timing of a pre-rotation of the photosensitive member before the image formation, inter-image timing between image forming operations for a plurality of images, or timing of a post-rotation of the photosensitive member after the image formation, or may be performed in accordance with timing of a predetermined operation performed on the printer such as an operation opening or closing an outer cover of a main unit of the printer, or timing of exchange of parts of the printer.

Movement may be performed nonperiodically but within a period setting surface roughness of the photosensitive member 1 only to an allowable extent.

The movement of the charging member 21" in accordance with the above timing can be performed, for example, by operating the charging member drive device 22 under the control by a controller CONT2 which controls the operation of the whole printer.

Figure 13:
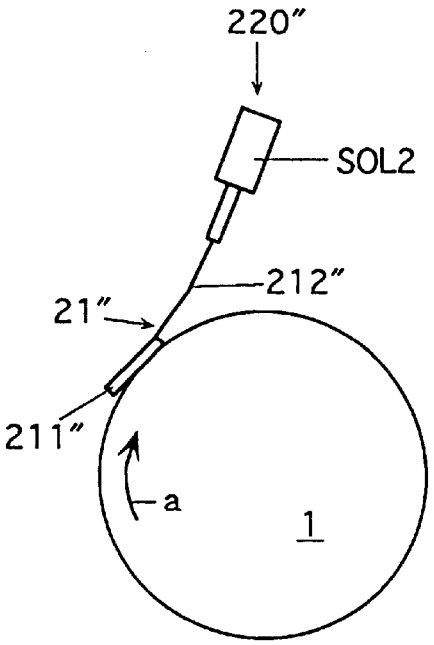
FIG. 13 shows another example of the auxiliary charging device.
Figure 14:
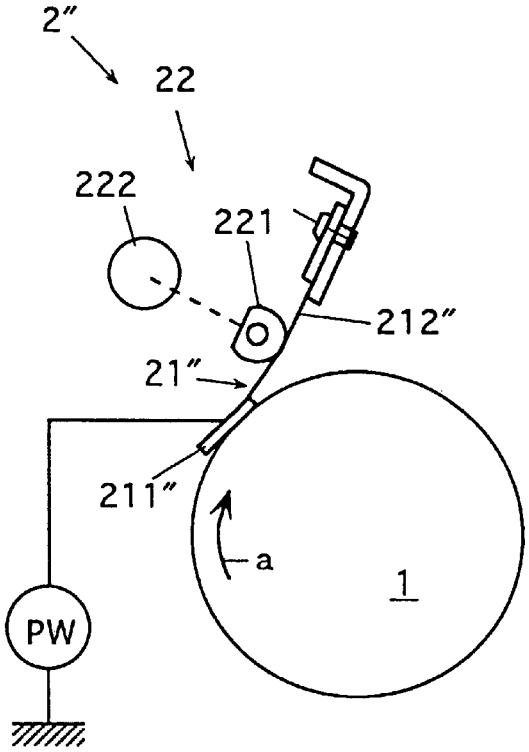
FIG. 14 shows still another example of the auxiliary charging device.

The charging device 2" employs the cam mechanism for driving the charging member 21". Alternatively, as shown in FIG. 13, a drive device 220" including a solenoid SOL2 may be employed for reciprocation. Also, as shown in FIG. 14, such a structure may be employed that the AC power source PW applies an AC voltage to the charging member 21" in the charging device 2" for changing the electrostatic attraction force toward the photosensitive member 1 in accordance with the periods of voltage application so that the charging member 21" vibrates and the foreign matters are passed also by this vibration. In this case, however, the charging portion 211" is formed of a semiconductive material of, e.g., $10^4$ Ωcm–$10^9$ Ωcm such as a styrene elastomer and carbon particles dispersed therein for generating the electrostatic attraction force. In this case, the cam mechanism may be eliminated.

Then, description will be given on experiments which were performed for determining a relationship between the roughnesses of the surfaces of various contact members in contact with the surface of the photosensitive member 1 and the surface roughnesses (Sm and Rz) of the surface of the photosensitive member 1 shaved thereby as well as a relationship between the densities of images formed by the photosensitive member 1 before being shave, i.e., in the initial state, and the densities of the same images formed by the shaved photosensitive member 1.

Rz is represented by ten-point average. Sm is a distance between tops.

The experiments were performed under the following conditions.

Charging brush roller 31 was formed of piles each having length of 5 mm.

The developing sleeve 42 of the developing/cleaning device 4 had a surface roughness Rz of 5 $\mu$m.

The surface 211*a*" of the blade portion 211" of the auxiliary charging device 2" had the surface roughness Rz of 1 $\mu$m.

The transfer roller 5 had the surface roughness Rz of about 1 $\mu$m.

Extents or degrees of shaving of the photosensitive member 1 by the members had the following relationship:

blade portion=transfer roller>charging brush>developing sleeve

Each of these members was used alone or in combination with one or more other member, and was brought into contact with the surface of the photosensitive member 1 which rotated at a predetermined speed. The results are shown in the following tables 1, 2 and 3.

In the tables 1 and 2, the "Initial" columns represent the initial state of the photosensitive member 1. The "Durability" column in the table 1 represents the surface roughness of the photosensitive member 1 after rotation of the photosensitive member 1 corresponding to image formation on 20000 sheets. The "Durability" column in the table 2 represents the surface roughness of the photosensitive member 1 after rotation of the photosensitive member 1 corresponding to image formation on 20000 sheets. "Density Difference" represents the difference between the density of the image formed by the photosensitive member in the initial state and the density of the same image formed by the photosensitive member after the above image rotation. The difference in image density at the acceptable level is represented by the "○" mark, and that in the unacceptable is represented by the "X" mark.

From the tables 1 and 2, the following can be understood. The allowable level, i.e., the reduced irregularities in the Macbeth density shown in FIG. 6 can be achieved by satisfying such conditions that Rz in the measurement range of 30 μm in the peripheral direction of the photosensitive drum is 0.6 μm or less when Sm is 200 μm or more and Rz is 3 μm or less, or when Sm is lower than 200 μm.

The table 3 represents the experimental results in such a case that the photosensitive member (P/C) 1 already having a surface roughness was shaved only by the developing sleeve. The durability was determined with the rotation of the photosensitive member corresponding to image formation of 20000 sheets.

TABLE 1

| | Only Brush | Brush + Sleeve |
|---|---|---|
| Initial | 0 μm | 0 μm |
| Durability | Rz = 1.9 μm<br>Sm = 80 μm | Rz = 1.5 μm<br>Sm = 157 μm |
| Density Difference | X | X |
| | **Brush + Sleeve + Blade** | **Brush + Sleeve + Roller** |
| Initial | 0 μm | 0 μm |
| Durability | Rz = 0.2 μm<br>Sm = 360 μm | Rz = 0.2 μm<br>Sm = 330 μm |
| Density Difference | ○ | ○ |

TABLE 2

| | Brush + Sleeve + Blade | Brush + Sleeve + Balde |
|---|---|---|
| Initial | 0 μm | 0 μm |
| Durability | Rz = 1.2 μm<br>Sm = 220 μm | Rz = 2.4 μm<br>Sm = 370 μm |
| Density Difference | ○ | ○ |

TABLE 3

| | Only Sleeve |
|---|---|
| Roughness of P/C | Rz = 1.9 μm<br>Sm = 80 μm |
| Durability | Rz = 1.0 μm<br>Sm = 210 μm |
| Density Difference with respect to the initial state | Δ (acceptable) |

(3) Third Type of Image Forming Apparatus

The third type of the image forming apparatus is an electrophotographic image forming apparatus, wherein a developing/cleaning device for performing simultaneous development and cleaning removes toner remaining on the image carrier having a moving surface after transfer onto a transfer target member of a visible toner image formed on the image carrier. A foreign matter removing device is arranged at a section defined in the moving direction of the image carrier surface between the transfer portion and the developing/cleaning device. The foreign matter removing device includes a foreign matter removing member having a foreign matter removing edge portion opposed to the image carrier surface, and the foreign matter removing edge portion is located at a distance ranging from 0 to 200 μm from the image carrier surface.

The foreign matter removing member is required to locate the foreign matter removing edge portion at a distance of 200 μm or less from the image carrier surface when removing the foreign matters. For this, the following two arrangements may be employed.

(3-A) The foreign matter removing member is arranged such that the foreign matter removing edge portion is spaced by 200 μm or less from the image carrier surface and, in other words, the foreign matter removing edge portion is always located at a distance of 200 μm or less from the image carrier surface (in the case of the image forming apparatus employing the stationary foreign matter removing member).

(3-B) The foreign matter removing device includes device for selectively locating the foreign matter removing member at a foreign matter removing position where a distance of 200 μm or less is kept between the foreign matter removing edge portion and the image carrier and a retreat position to which the edge portion retreats from the foreign matter removing position. This selectively arranging device locates the foreign matter removing member at the foreign matter removing position in accordance with predetermined timing (in the case of the image forming apparatus employing the movable foreign matter removing member).

In either the cases (3-A) and (3-B), the distance of 200 μm or less is kept between the foreign matter removing edge portion and the image carrier surface when the foreign matter removing member is located at the foreign matter removing position. This value of 200 μm is determined based on the consideration that the foreign matter has a size over 200 μm, and therefore the foreign matter can be removed by setting the distance between the foreign matter removing edge portion and the image carrier surface to 200 μm or less. For safety or margin, the distance between the foreign matter removing edge portion and the image carrier surface may be set to 100 μm or less and, more preferably, to 50 μm or less. The distance of 200 μm or less, preferably 100 μm or less, and more preferably 50 μm or less is set, and therefore the distance of 0 μm is allowed, in which case the foreign matter removing edge portion is in contact with the image carrier surface.

The structures in the above cases (3-A) and (3-B) will now be described below more in detail.

(3-A) In the image forming apparatus employing the stationary foreign matter removing member, the foreign matters such as paper powder and untransferred residual toner remaining on the image carrier after transfer of the visible toner image onto the transfer target member reach the foreign matter removing device arranged at the section between the transfer portion and the developing/cleaning device. Since the foreign matter removing edge portion of the foreign matter removing member of the foreign matter removing device is spaced from the image carrier by the distance of 200 μm or less (preferably 100 μm or less, and more preferably 50 μm or less), the foreign matters larger in size than this space distance are checked by the foreign matter removing edge portion. The untransferred residual toner has a smaller particle diameter than the foreign matters. Therefore, it is possible to allow passage of the residual toner through a position between the foreign matter removing member and the image carrier by controlling a pressure between them even when they are in contact with each other. Alternatively, the passage of the residual toner may be allowed, for example, by appropriately moving the foreign matter removing member, if necessary. The untransferred residual toner passed through the position between the foreign matter removing member and the image carrier reaches the developing/cleaning device and is collected thereby.

In this manner, the foreign matters are removed so that image noises such as black and white spots, which are liable to occur due to the foreign matters, are suppressed, and good images can be obtained.

In the image forming apparatus having the foregoing structure (3-A), the foreign matter removing member may be arrange with respect to the image carrier such that the foreign matter removing member is in contact with the image carrier surface through its portion downstream, in the surface moving direction of the image carrier, from the foreign matter removing edge portion, and the foreign matter removing edge portion projects upstream, in the surface moving direction of the image carrier, with a space of 200 μm (preferably 100 μm or less, and more preferably 50 μm or less) kept with respect to the image carrier. In this case, the foreign matter removing device may be provided with a drive device which can reciprocate the foreign matter removing member along the image carrier surface while keeping the projected state of the foreign matter removing edge portion and keeping the space of 200 μm or less (preferably 100 μm or less, and more preferably 50 μm or less) between the foreign matter removing edge portion and the image carrier. Alternatively, the foreign matter removing device may include a drive device (e.g., vibrating drive device) which can bring into contact and release the foreign matter removing member with and from the image carrier surface while keeping a space of 200 μm or less (preferably 100 μm or less, and more preferably 50 μm or less) between the foreign matter removing edge portion and the image carrier).

In either case, arrangement of the foreign matter removing edge portion projected upstream can suppress smear of the edge portion by the toner.

As another example, the foreign matter removing device may include a device which can reciprocate the foreign matter removing member between a position where an edge of the foreign matter removing edge portion near the image carrier is in contact with the image carrier surface and a position where the foreign matter removing edge portion projects upstream in the moving direction of the image carrier surface with a space of 200 μm or less (preferably 100 μm or less, and more preferably 50 μm or less) from the image carrier.

In still another example, the foreign matter removing device may include a device which can reciprocate the foreign matter removing member between a position where an edge of the foreign matter removing edge portion near the image carrier is in contact with the image carrier surface and a position where the edge portion is located at a distance of 200 μm or less (preferably 100 μm or less, and more preferably 50 μm or less) from the image carrier.

In yet another example, the foreign matter removing device may include a device (e.g., vibrating device) which can reciprocate the foreign matter removing member between a position where an edge of the foreign matter removing edge portion near the image carrier is in contact with the image carrier surface and a position where the edge is spaced from the image carrier by a distance of 200 μm or less (preferably 100 μm or less, and more preferably 50 μm or less).

In any of the above cases, the foreign matter removing member may be a dedicated member or a member serving also as an auxiliary charging member. In the latter case, the auxiliary charging member is arranged in a section defined, in the moving direction of the image carrier surface, between a transfer portion where a visible image is transferred onto the transfer target member and a main charging device for charging the image carrier surface. This auxiliary charging member can charge untransferred residual toner and others, which are charged to the polarity opposite to that of the voltage applied to the main charging device, to the same polarity as that of the voltage applied to the main charging device.

The foreign matter removing member may typically be a blade-like member, although not restricted thereto.

The blade-like member may have a blade portion contributing directly to the removal of the foreign matters and a support portion supporting the blade portion, and thus have a blade-like form as a whole. Alternatively, the blade-like member may have a blade-like form in the literal sense.

If the blade-like member is employed as the foreign matter removing member, the blade-like member may be a flexible blade-like member having an elastic restoring property. In this case, the drive device for the foreign matter removing device may have, for example, a structure (3-*a*) including a cam device having a cam which applies and releases a pressing force against the blade-like member and thereby can reciprocate the blade-like member along the image carrier surface by utilizing the elastic restoring force of the blade-like member, a structure (3-*b*) including an electrostatic attraction force applying device which applies and releases an electrostatic attraction force against the blade-like member and thereby can reciprocate or vibrate the blade-like member along the image carrier surface by utilizing the elastic restoring force of the blade-like member to move the blade-like member toward and away from the image carrier surface; or a structure (3-*c*) including a solenoid-actuated drive device which acts on the blade-like member to reciprocate the blade-like member along the image carrier surface.

In the case where the electrostatic attracting force applying device is employed together with another drive device, application and release of the electrostatic attraction force is preferably performed without synchronization with the operations of the foreign matter removing member driven by another drive device.

(3-B) In the image forming apparatus employing the movable foreign matter removing member, the following structure may be employed in the selectively locating device for selectively locating the foreign matter removing member at the foreign matter removing position where a distance of 200 μm or less (preferably 100 μm or less, and more preferably 50 μm or less) is kept between the foreign matter removing edge portion and the image carrier and a retreat position to which the edge portion retreats from the foreign matter removing position.

The selectively locating device may include an electrostatic attraction semiconductive member supported by the foreign matter removing member and opposed to the image carrier surface, and switching device for selectively performing and stopping application of electric charges for electrostatic attraction from the power source to the semiconductive member. The semiconductive member supplied with the charges is electrostatically attracted to the image carrier and thereby locates the foreign matter removing member at the foreign matter removing position. Also, the semiconductive member not supplied with the charges is released from the electrostatic attraction force to allow retreat of the foreign matter removing member from the foreign matter removing position to the retreat position.

In the image forming apparatus of this type (3-B), foreign matters such as paper powder and untransferred residual toner, which remains on the image carrier after transfer of the visible toner image onto the transfer target member, reach the foreign matter removing device arranged between the transfer portion and the developing/cleaning device.

The foreign matter removing member in the foreign matter removing device is located at the foreign matter removing position in accordance with a predetermined timing. In this position, the distance of 200 $\mu$m or less (preferably 100 $\mu$m or less, and more preferably 50 $\mu$m or less) is kept between the foreign matter removing edge portion and the image carrier. Therefore, foreign matters larger in size than this distance is checked by the foreign matter removing edge portion. The untransferred residual toner has smaller particle diameters than the foreign matters. Therefore, even if the foreign matter removing member is in contact with the image carrier, it is possible to pass the untransferred residual toner through an area between them by appropriately adjusting, e.g., a pressure between them or, if necessary, by appropriately moving the foreign matter removing member. The untransferred residual toner passed through the position between the foreign matter removing member and the image carrier reaches the developing/cleaning device, and is collected by the same.

Since the foreign matters are removed in this manner, it is possible to suppress image noises such as black and blank (white) spots, which are liable to appear due to the foreign matters, and therefore good images can be produced.

The following operation can be performed by the above structure in which the foreign matter removing member supports the semiconductive member for electrostatic attraction, and the switching device is employed for selectively performing and stopping application of the charges for electrostatic attraction from the power source to the semiconductive member. When the switching device operates to apply the charges for electrostatic attraction from the power source to the semiconductive member in accordance with predetermined timing, the semiconductive member is electrostatically attracted to the image carrier surface so that the foreign matter removing member moves toward the image carrier and reaches the foreign matter removing position, where the foreign matter removing member can remove the foreign matters. When the switching device operates to stop application of the charges, the electrostatic attraction force is released so that the foreign matter removing member retreats from the foreign matter removing position to the retreat position. This retreat to the spaced position may be executed by a return device such as a device including a spring, which is provided for this purpose, or may be preferably performed by a simple structure, in which an end portion of the foreign matter removing member remote from the foreign matter removing edge portion is supported in a cantilever manner, and an elastic restoring force of the foreign matter removing member is utilized for retreat to the spaced position.

The switching device can locate the foreign matter removing member at the foreign matter removing position, for example, in accordance with timing which will be described below.

The foreign matter removing member can be located at the foreign matter removing position during either the image formation or the image non-formation.

If the foreign matter removing member is located at the foreign matter removing position during the image formation, it can be used also as the auxiliary charging member before charging of the image carrier by the main charging device. If the foreign matter removing member has the function of auxiliary charging, the number of parts can be reduced in the structure provided with the auxiliary charging member. Also, a space required around the image carrier can be reduced so that the image forming apparatus can be reduced in size and cost. If the foreign matter removing member in the foreign matter removing position is in contact with the image carrier, the foreign matter removing member may be retreated to a position spaced from the image carrier during the image non-formation so as to suppress damage to the image carrier surface.

If the foreign matter removing member is located at the foreign matter removing position during the image non-formation, the following structure may be employed. The foreign matter removing member stays at the foreign matter removing position for a time corresponding to one rotation of the image carrier during the image non-formation, if the image carrier is a rotary member. By locating the foreign matter removing member at the foreign matter removing position only temporarily during the image non-formation, damage to the image carrier can be suppressed even in the structure in which the foreign matter removing member in the foreign matter removing position is in contact with the image carrier. In the structure where the foreign matter removing member stays at the foreign matter removing position for a time corresponding to one rotation during the image non-formation, it may stay at this position either before or after the image formation. However, it is generally preferable that one idle rotation of the image carrier for the above purpose is preferably performed after the image formation because one idle rotation of the image carrier before the image formation delays the start of the image formation.

The operation of continuously performing image formation for a plurality of transfer members takes a long time if the foreign matter removing member is located at the foreign matter removing position after (or before) every image forming operation. In the continuous image formation, therefore, it is preferably to locate the foreign matter removing member at the foreign matter removing position after the image formation for all the intended transfer members is completed.

In the structure where the foreign matter removing member is located at the foreign matter removing position after completion of the image formation and more specifically after possible passage of the untransferred residual toner through a position opposed to the foreign matter removing member, the untransferred residual toner is already removed by the developing/cleaning device prior to the above passage. Therefore, the foreign matter removing member can be mounted on the main unit of the image forming apparatus in the assembly operation without taking into consideration the assembly conditions that the assembly must be performed at a high accuracy to enable removal of the foreign matters while allowing passage of the residual toner. This simplifies the operation of mounting the foreign matter removing member, and the image forming apparatus can be manufactured inexpensively.

In any of the foregoing structures employing the foreign matter removing members which are selectively brought into contact with and spaced from the image carrier, damage such as shaving of the image carrier surface can be suppressed compared with the structure employing the foreign matter removing member which is always in contact with the image carrier.

The foreign matter removing device can have a simple and inexpensive structure by employing the structure in which the semiconductive member drives the foreign matter removing device and, more preferably, by employing the structure in which the foreign matter removing member is supported in the cantilever manner for enabling retreat to the retreat position by its elastically restoring force.

The foreign matter removing member may typically be a blade-like member or a sheet-like member, although not restricted thereto. The blade-like or sheet-like member may have a portion contributing directly to the removal of the foreign matters and a support portion supporting the portion, and thus have a blade-like or sheet-like form as a whole. Alternatively, the blade-like or sheet-like member may have a blade-like or sheet-like form in the literal sense. The semiconductive member may be typically a film-like member.

In the structure wherein the foreign matter removing member is supported in a cantilever manner to produce the elastic restoring force for retreat from the foreign matter removing position to the spaced position, the foreign matter removing member in the spaced position and the image carrier may be spaced from each other by a distance of typically about 0.5 mm, although this distance depends on the modulus of elasticity of the foreign matter removing member and the electrostatic attraction force by the semiconductive member.

The semiconductive member may be made of semiconductive film typically having a surface resistance of $10^4$ ohm/square (Ω/□)–$10^7$ ohm/square(Ω/□) and a thickness of 50 μm–100 μm, although not restricted thereto, and more preferably may be made of film having a sufficient resistance against smearing by toner or the like. Such a semiconductive film may be made of material containing, e.g., synthetic resin (e.g., fluororesin having a high resistance against smear) and electrically conductive carbon powder dispersed therein.

In the structure where the semiconductive film is employed and the foreign matter removing member is supported in the cantilever manner as described above, it is preferable that the close contact nip width of about 5 mm or more is kept between the image carrier and the semiconductive member electrostatically attracted thereto, although it depends on the modulus of elasticity of the foreign matter removing member.

For simplifying the structure of the image forming apparatus, the power source for applying the charges to the semiconductive member may be the same as that for the main charging device for charging the image carrier surface prior to the image formation. In this case, the voltage applied to the semiconductive member may be in a range from about 1000 V to about 1400 V in absolute value, although not restricted thereto.

In any of the above cases, the semiconductive member may be in contact with the image carrier or may be spaced from the image carrier while the electric charges are not supplied thereto.

The material of the foreign matter removing member may be, for example, resin such as polyurethane which is also a material of a cleaning blade generally used for removing the untransferred residual toner.

The foreign matter removing member supported in a cantilever manner may typically have a modulus of elasticity of 20 kg/mm$^2$–60 kg/mm$^2$, a thickness of about 1 mm and a free length of about 20 mm, although not restricted thereto. If the modulus of elasticity is small, the semiconductive member at the foreign matter removing position may be twisted by a force pulling the same toward the image carrier. In this case, a member for preventing twisting, which can be in contact with the foreign matter removing member, may be arranged between the foreign matter removing member and the image carrier.

When the foreign matter removing member is located in the foreign matter removing position, its foreign matter removing edge portion may be in contact with the image carrier through its edge near the image carrier. Alternatively, the foreign matter removing portion is in contact with the image carrier surface through its portion downstream, in the moving direction of the image carrier surface, from the foreign matter removing edge portion, and the foreign matter removing edge portion may project upstream in the moving direction of the image carrier surface with a space of 200 μm or less (preferably 100 μm or less, and more preferably 50 μm or less) from the image carrier.

In this structure including the projecting portion, smear of the foreign matter removing edge portion by the toner can be suppressed, and it is also possible to suppress instantaneous flow of a large amount of residual toner when the foreign matter removing member retreats to the retreat or spaced position.

In any of the foregoing image forming apparatuses according to the invention, the foreign matter removing edge portion may have a hardness of 40 degrees or more (JIS K7215 type A durometer) at least at the foreign matter checking end surface faced in the moving direction of the image carrier surface for effective removal of the foreign matters.

In the foreign matter removing edge portion of the foreign matter removing member described above, the edge neighboring and opposed to the image carrier may have a sectional contour, of which curvature radius (radius of curvature) is 100 μm or less and more preferably 50 μm or less for suppressing entry of foreign matters into a position under the edge and thereby improving the foreign matter removing effect.

For checking the foreign matters, the foreign matter removing member may be in contact with the image carrier with a pressure in a range from 0.05 g/mm to 10.0 g/mm.

In the image forming apparatus of the type (3-B) employing the movable foreign matter removing member, the pressure of the foreign matter removing member against the image carrier may be in a range from 0.5 g/mm to 0.8 g/mm, although not restricted thereto.

A portion of the foreign matter removing member which is in contact with the image carrier may have an anti-wear index (JIS K6264) of 1.0 or more for suppressing deformation with use.

The foreign matter checking end surface of at least the foreign matter removing edge portion of the foreign matter removing member, which is faced in the moving direction of the image carrier surface, may be made of a material having an SP (solubility parameter) value close to the SP value of the foreign matters for improving a tacking property of tacking and sticking the foreign matters thereto and thereby improving the effect of removing the foreign matters.

For improving the effect of removing the foreign matters in the image forming apparatus of the type (3-A) employing the stationary foreign matter removing member, the foreign matter removing member may be supplied with the electrostatic attraction voltage of a polarity opposite to that of the transfer voltage applied at the transfer portion, and the foreign matter removing edge portion of the foreign matter removing member may have at least the foreign matter checking end surface faced in the moving direction of the image carrier surface and having a resistance value of $10^4$ Ωcm–$10^{10}$ Ωcm. This improves the performance of electrostatically attracting the foreign matters.

A specific example of the image forming apparatus of the third type will now be described below with reference to the drawings.

Figure 16:
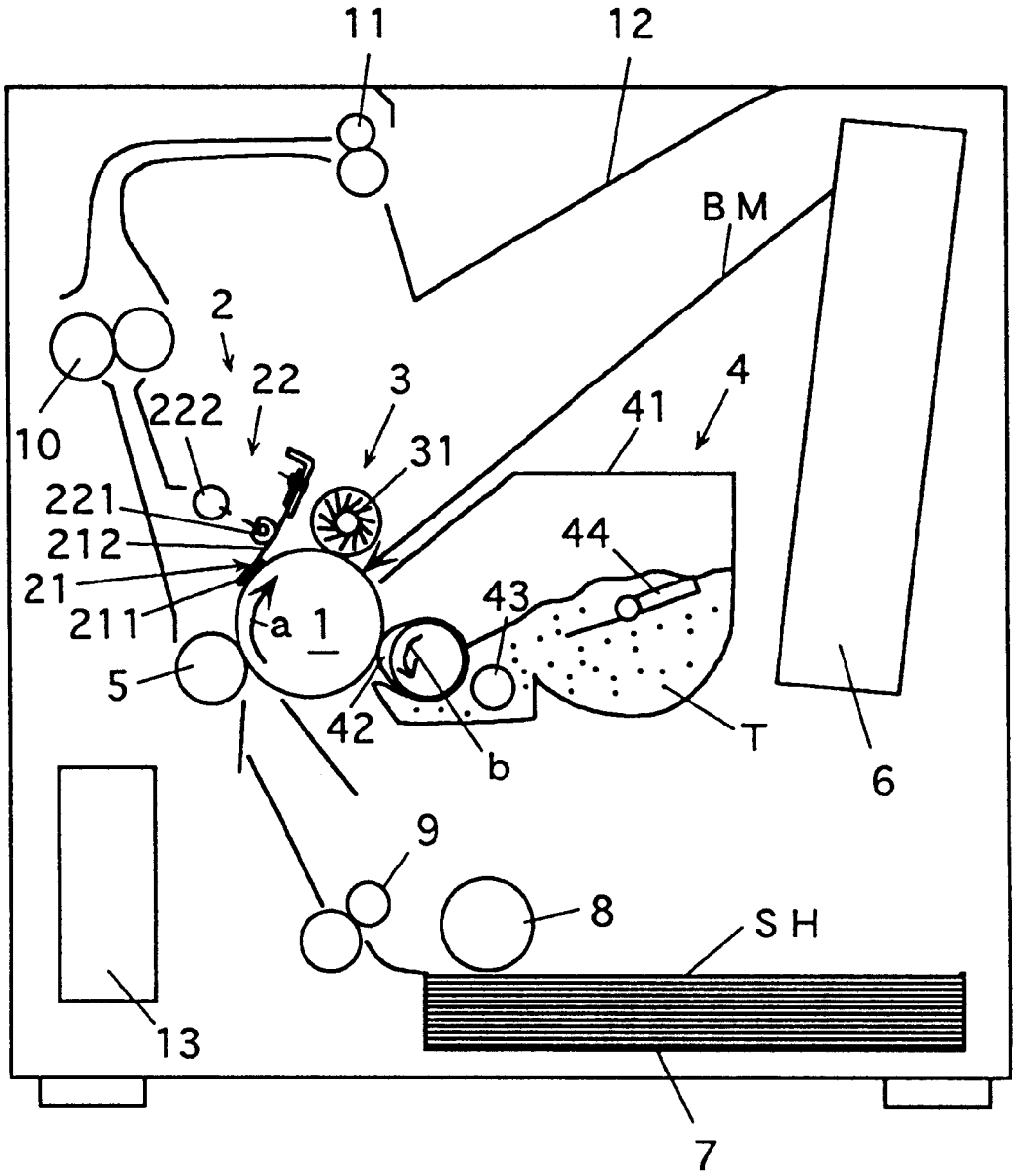
FIG. 16 shows a schematic structure of an example (printer) of an image forming apparatus of a third type according to the invention.

FIG. 16 shows an example of the image forming apparatus of the third type, and more specifically shows a schematic structure of the laser beam printer performing the reversal development.

This laser beam printer employs an auxiliary charging device 2 instead of the auxiliary charging device 2' in the printer shown in FIG. 1. Structures other the above are the substantially same as those of the printer shown in FIG. 1. Parts and portions having the substantially same structures or functions as those in the printer shown in FIG. 1 bear the same reference numbers.

Figure 17:
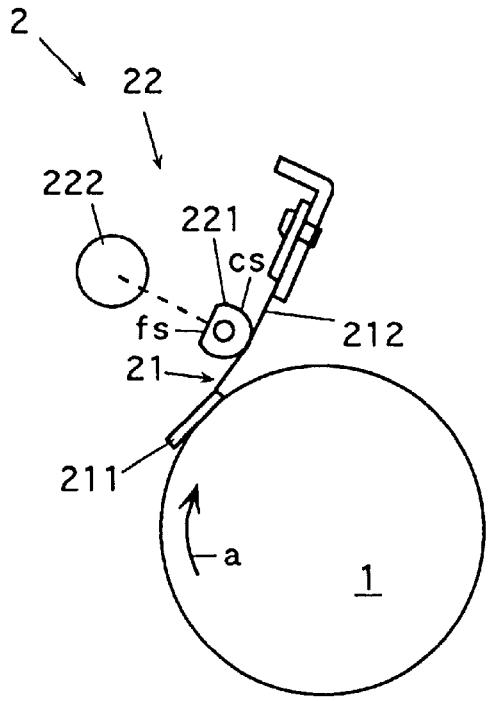
FIG. 17(A) is a side view showing, on an enlarged scale, an auxiliary charging device also serving as a foreign matter removing device of the printer in FIG. 16 with its charging member located at a position.
FIG. 17(B) shows the same with its charging member located at another position.
Figure 17:
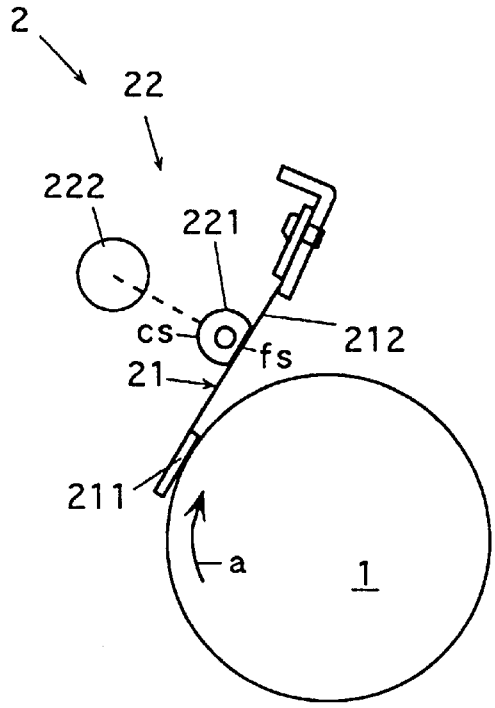

The auxiliary charging device 2 also serves as the foreign matter removing device, and includes a blade-like charging member 21, which has an elastic restoring property as a whole and can serve also as a flexible foreign matter removing member, and a member drive device 22 as shown in FIGS. 17(A) and 17(B).

The blade-like member 21 is formed of a belt-like blade portion 211 which is in contact with the surface of the photosensitive member 1 and a supporting portion 212 supporting the portion 211. The support portion 212 is formed of a flexible plate spring having a high elastic restoring property. The supporting portion 212 is supported in a cantilever manner at its downstream end, in the moving direction a of the photosensitive member surface, on a fixed position, and supports at its upstream end the blade portion 211. The blade portion 211 has a surface 211*a* (see FIG. 18(A)) opposed to the photosensitive member 1 and having a portion which is in contact with the surface of the photosensitive member 1 (see FIG. 18(A) and 18(B)).

The member drive device 22 is the substantially same as the charging member drive device 22 shown in FIG. 1. The parts and portions having the same structures or operations as those in the device 22 in FIG. 1 bear the same reference numbers.

Figure 18:
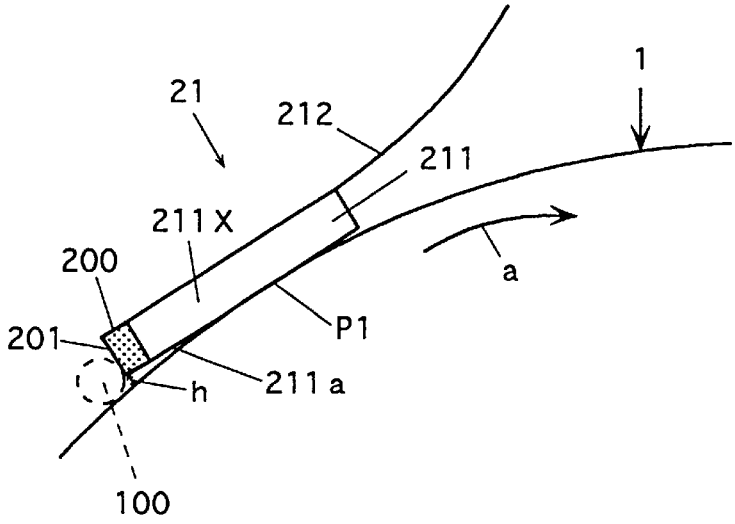
FIG. 18(A) shows, on an enlarged scale, a portion in FIG. 17(A)
FIG. 18(B) shows, on an enlarged scale, a portion in FIG. 17(B)
FIG. 18(C) shows a curvature radius (curvature of radius) of an edge of a foreign matter removing edge portion.
Figure 18:
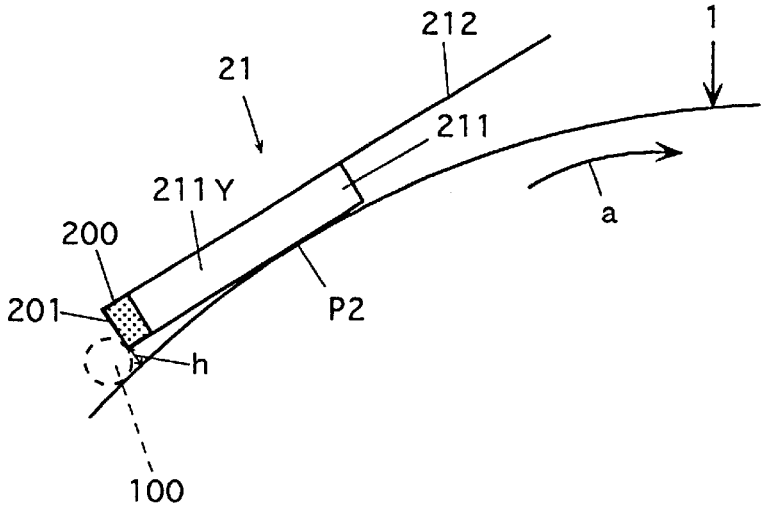
Figure 18:
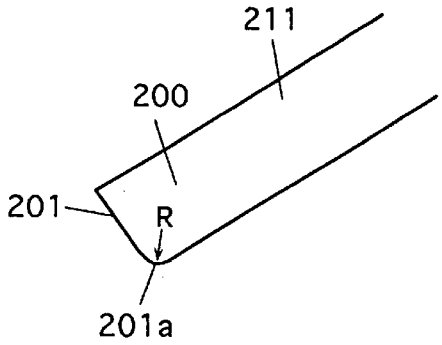

The support portion 212 is pushed downward to a position shown in FIGS. 17(A) and 18(A) by the cam 221 when its outer peripheral curved surface cs comes into contact with the support portion 212. In the position shown in FIG. 18(A), a downstream portion P1, in the surface moving direction a of the photosensitive member 1, of the blade portion 211 is in contact with the photosensitive member. The projecting portion 211*x* is located upstream to the photosensitive member surface.

A free edge portion 200 of this projecting portion forms the foreign matter removing edge portion.

When the cam 221 rotates to bring the flat surface fs into contact with the support portion 212, the support portion 212 elastically restores to the position shown in FIGS. 17(B) and 18(B). In the position shown in FIG. 18(B), the blade portion 211 is in contact with the photosensitive member 1 through a portion P2 downstream, in the surface moving direction a of the photosensitive member 1, from the contact portion P1, and thereby form a downward projecting portion 211Y.

When the cam 221 rotates, the blade-like member 21 reciprocates along the moving direction of the photosensitive member surface so that variation occurs in length of the portion of the blade-like member 21 projected from the contact portion.

When the projection length increases as shown in FIG. 18(B), a pressure of the blade portion 211 against the photosensitive member 1 decreases. Independently of the position of the blade-like member 21, however, the space distance between the foreign matter removing edge portion 200 and the photosensitive member 1 is set to a value of 200 μm or less for checking the foreign matters 100. For more reliably checking of the foreign matters, the distance may be set to 100 μm or less, or 50 μm or less instead of 200 μm or less.

The blade portion 211 of the blade-like member 21 is provided with the foreign matter removing edge portion 200 which satisfies at least one of the following conditions (a)–(e) for the purpose of reliably checking the foreign matters.

(a) At least the foreign matter checking end surface 201 faced in the moving direction of the photosensitive member surface has a hardness of 40 degrees or more (JIS K7215 type A durometer).

(b) In the foreign matter removing edge portion, the edge 201*a* neighboring and opposed to the image carrier has a sectional contour having a curvature radius R (see FIG. 18(C)) of 100 μm or less and more preferably 50 μm or less.

(c) The voltage for electrostatic attraction is applied to at least the foreign matter checking end surface 201 faced in the moving direction of the image carrier surface, and at least the end surface 201 has the resistance value of $10^4$ Ωcm–$10^{10}$ Ωcm.

(d) The anti-wear index is 1.0 or more (JIS K6264).

(e) The foreign matter checking end surface 201 is made of the material having the SP (solubility parameter) value close to the SP value of the foreign matters.

Figure 24:
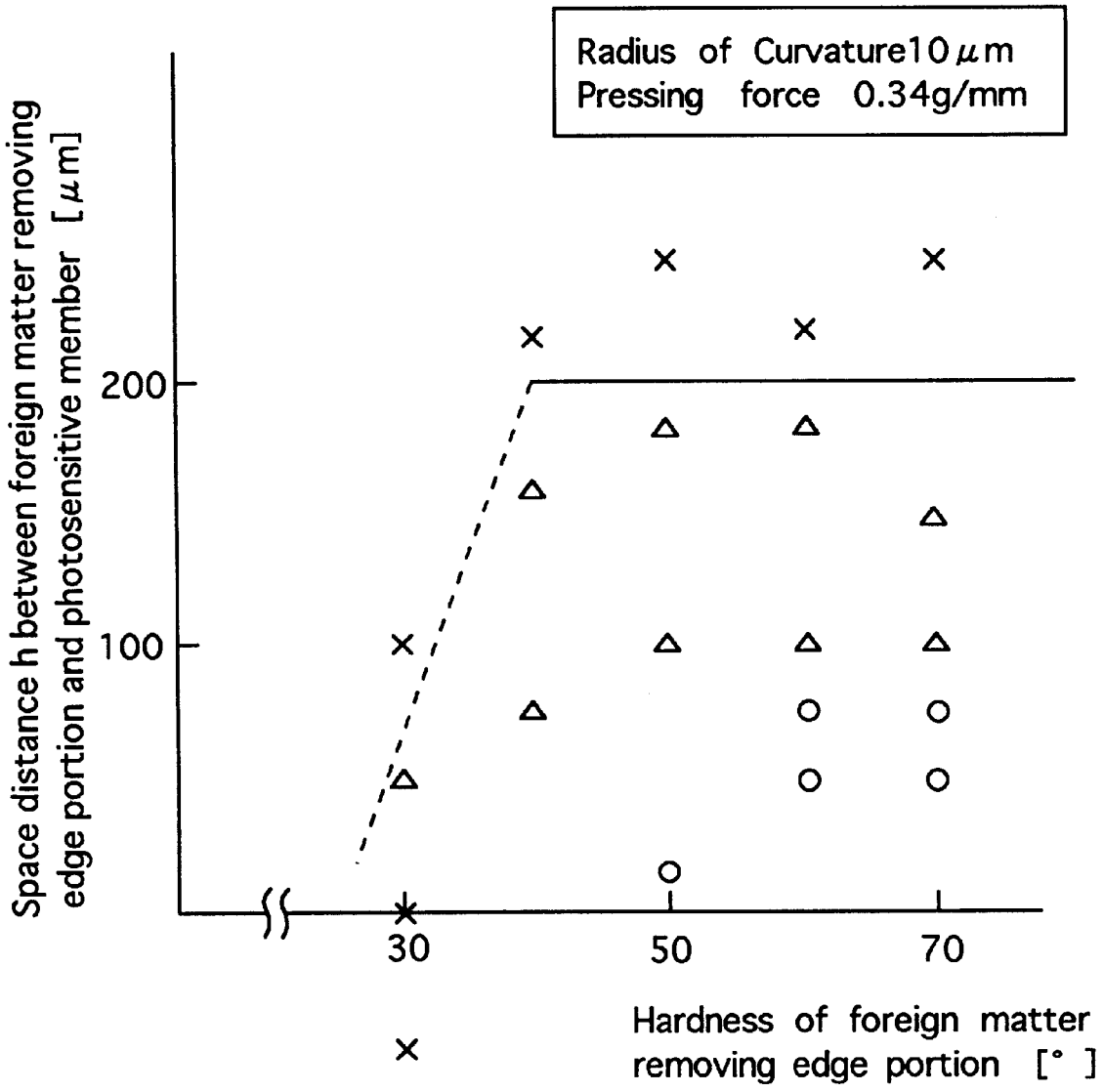
FIG. 24 shows results of an experiment for determining a relationship between a distance, which is defined between the foreign matter removing edge portion and the photosensitive member, and a hardness of the edge portion.
Figure 25:
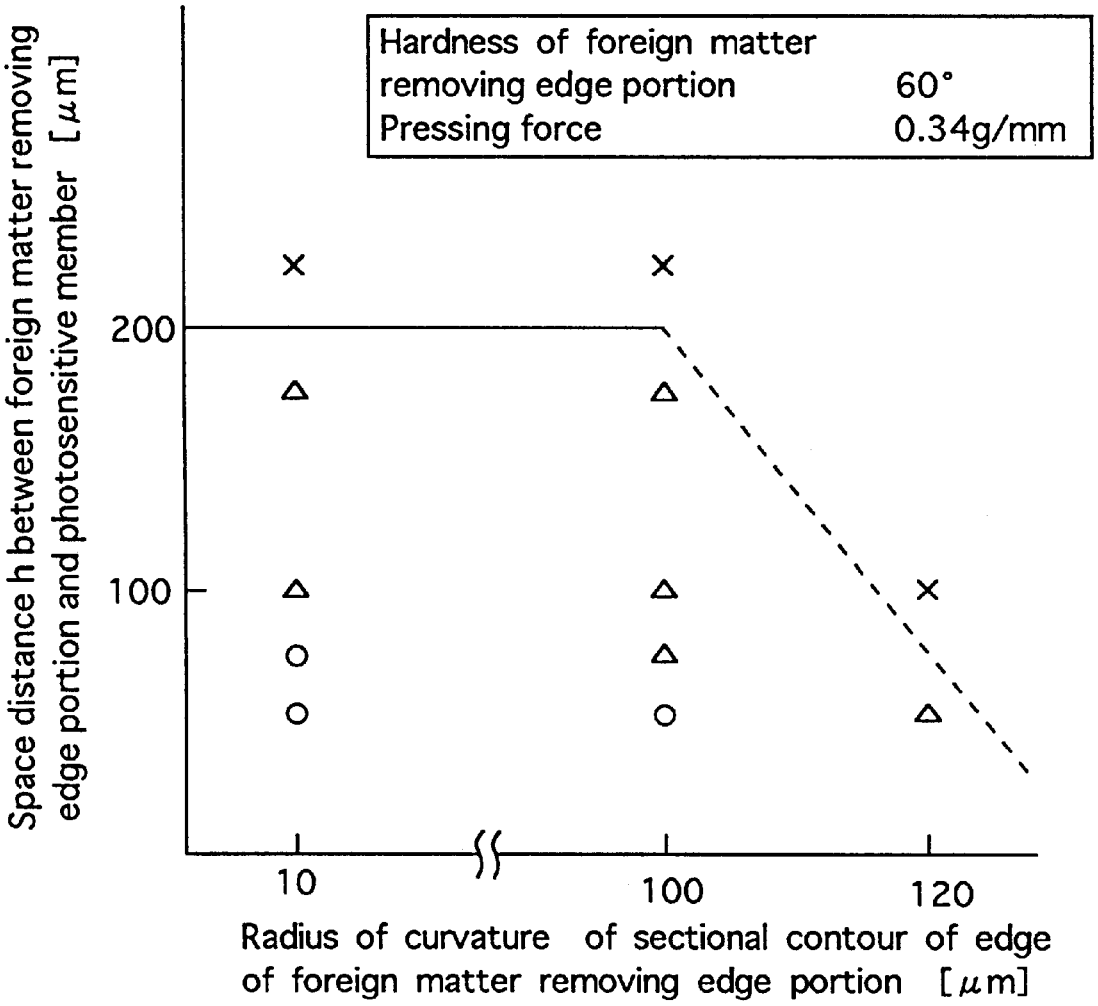
FIG. 25 shows results of an experiment for determining a relationship between a distance, which is defined between the foreign matter removing edge portion and the photosensitive member, and a curvature radius of the edge portion.
Figure 26:
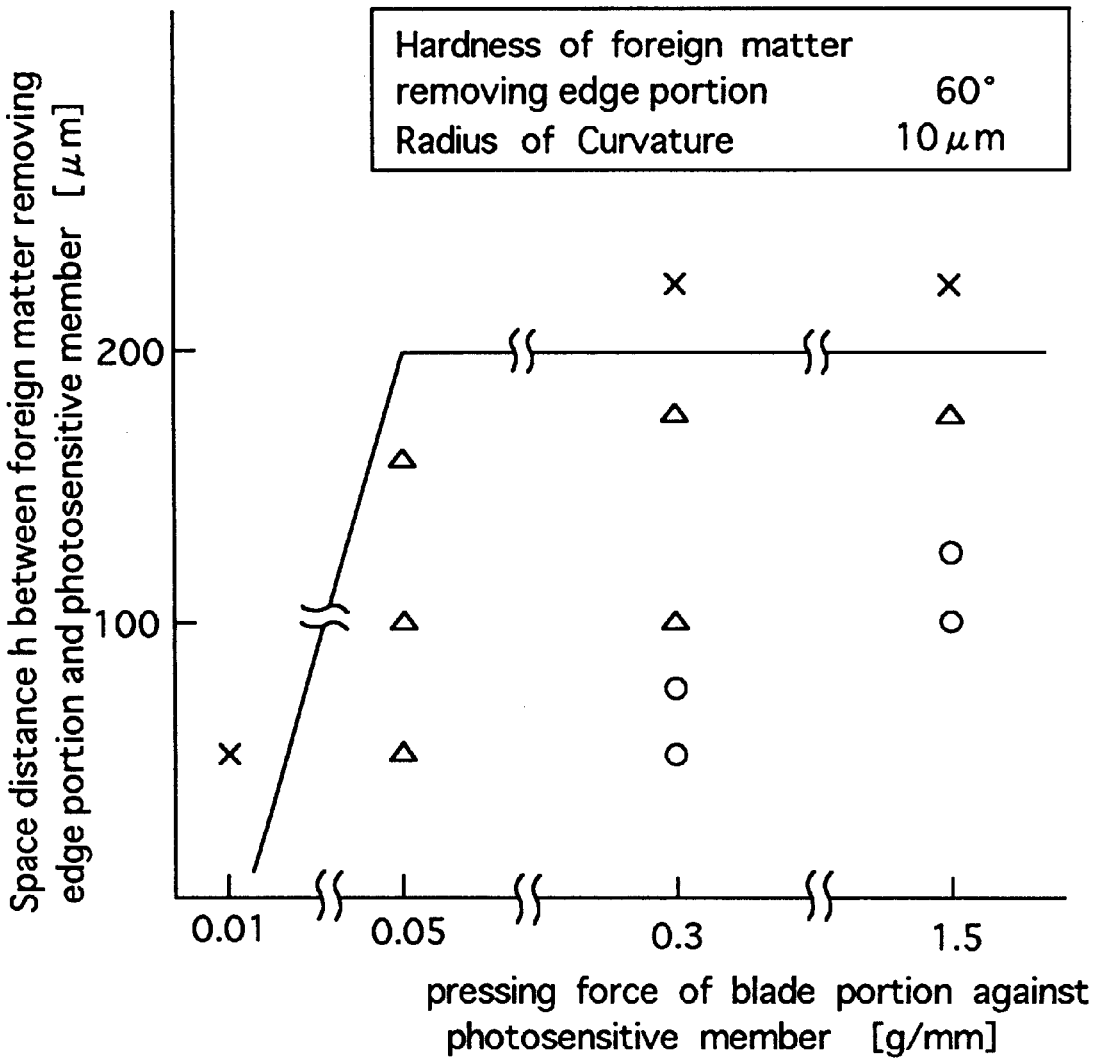
FIG. 26 shows results of an experiment for determining a relationship between a distance, which is defined between the foreign matter removing edge portion and the photosensitive member, and a pressing force of the edge portion against the photosensitive member.

FIG. 24 shows results of an experiment for determining a relationship between the space distance h, which is defined between the foreign matter removing edge portion 200 and the photosensitive member 1, and the hardness of the edge portion 200. FIG. 25 shows results of an experiment for determining a relationship between the space distance h and the curvature radius R of the sectional contour of the edge 201*a* of the edge portion 200. FIG. 26 shows results of an experiment for determining a relationship between the space distance h and the pressing force of the blade portion 211 against the photosensitive member 1.

In FIGS. 24 to 26, the mark "X" represents that no effect of removing the foreign matter is achieved, the mark "Δ" represents that an effect of removing the foreign matters is achieved, the mark "○" represents that a sufficient effect of removing the foreign matters is achieved.

The foregoing conditions for the hardness, curvature radius of the edge and pressing force are determined from the results of the experiments.

In these experiments, the edge portion 200 of the blade portion 211 was made of urethane and carbon particles dispersed therein, and had the resistance value of $10^4$ Ωcm–$10^{10}$ Ωcm. The other portion of the blade portion 211 was made of styrene elastomer and carbon particles dispersed therein.

The blade portion 211 was pressed by the cam 221 against the photosensitive member 1 with a pressure in a range from 0.05 g/mm to 10.0 g/mm.

The blade-like member 21 was supplied with the DV voltage of −1350 V from the power source 13, although not restricted thereto.

The purpose or function of the auxiliary charging device 2 will be described later.

The developing/cleaning device 4 is the same as the developing/cleaning device 4 shown in FIG. 1, and the parts and portions having the same structures or functions as those in the developing/cleaning device 4 in FIG. 1 bear the same reference numbers.

In the developing/cleaning device, the developing sleeve 42 is likewise supplied with a bias voltage in a range from −100 V to −500 V (−300 V supplied from the power source 13 in this embodiment) so as to generate an electric field for transporting the toner T, which has the electric charges of the same polarity as the chargeable polarity of the photosensitive member 1, to the photosensitive member 1 and, in other words, for moving the toner T from the developing sleeve 42 to the laser-irradiated portion (exposed portion) on the photosensitive member 1. The rotary members in the developing/cleaning device 4 are driven to rotate by the drive device (not shown).

The transfer roller 5 is supplied with a transfer voltage from the power source 13. The transfer voltage has a polarity opposite to that of the toner, and is in a range from +1 kV to +5 kV, although not restricted thereto. Owing to application of the transfer voltage, the visible toner image on the photosensitive member is electrostatically attracted and transferred onto the transfer sheet SH transported to a position between the transfer roller 5 and the photosensitive member 1.

The laser device 6 is the same as the laser device 6 shown in FIG. 1.

According to the laser beam printer described above, the photosensitive member 1 is driven to rotate for the image formation, and the surface of the photosensitive member 1 is uniformly charged by the charging brush roller 31 while being affected by the charging by the auxiliary charging device 2 so that the potential thereon attains nearly −800 V in this embodiment. The charged region is subjected to the exposure based on the image information by the laser device 6 so that the electrostatic latent image is formed. This electrostatic latent image is developed by the developing/cleaning device 4 into the visible image. During the above operations, the feed roller 8 feeds the transfer sheet SH from the sheet cassette 7 to the timing roller pair 9, which transfers, in synchronization with the toner image on the photosensitive member 1, the sheet SH to the transfer portion between the transfer roller 5 and the photosensitive member 1. In this manner, the transfer roller 5 transfers the visible toner image onto the transfer sheet SH. Then, the transfer sheet SH passes through the fixing roller pair 10 to fix the toner image, and then is discharged onto the discharged sheet tray 12 by the sheet discharge roller pair 11.

After the transfer, the untransferred residual toner remaining on the photosensitive member 1 contains toner which is charged positively, i.e., to the polarity opposite to the normally charged polarity due to an influence by the application of the positive voltage from the transfer roller 5 during transferring and other influence. If the positively charged toner were sent to the charging brush roller 31, it would adhere to the roller 31 carrying the negative voltage, in which case charging of the photosensitive member 1 would be adversely affected, resulting in problems such as black stripes or coarse images in halftone images.

In this embodiment, however, the untransferred residual toner first reaches the auxiliary charging device 2 in accordance with rotation of the photosensitive member 1.

The blade-like member 21 of the auxiliary charging device 2 is supplied with the DC voltage of −1350 V as already described, and charges the photosensitive member surface to about −800 V in this embodiment. It also charges the untransferred residual toner passing therethrough to substantially −30 $\mu$c/g. In this manner, the untransferred residual toner charged to the opposite polarity is charged to attain the intended polarity, i.e., negative polarity, and therefore is prevented from adhesion to the charging brush roller 31 which the toner will reach. Thereby, the brush roller 31 can charge the photosensitive member without a difficulty.

Also, the charging brush roller 31 disperses the untransferred residual toner so that so-called exposure eclipse during the exposure by the laser device 6 can be suppressed.

When new image formation is not performed subsequently, the untransferred residual toner moves to the developing/cleaning device 4. If new image formation is to be performed subsequently, the laser device 6 radiates the laser beam BM corresponding to the next image information to the surface of the photosensitive member 1 carrying dispersed residual toner. The potential of the portion, which is irradiated with the laser and will be referred to as the image portion, is lowered with respect to a portion, which is not irradiated with the laser and will be referred to as the non-image portion, so that a new electrostatic latent image is formed.

The new electrostatic latent image thus formed moves to a position of the developing sleeve 42 of the developing/cleaning device 4 in accordance with rotation of the photosensitive member 1, and is developed with the developing bias. Simultaneously with the developing, the untransferred residual toner T located at the non-image portion is electrostatically attracted and collected by the developing sleeve 42 owing to the difference between the potential of the non-image portion and the developing bias potential.

As already described with reference to FIGS. 18(A) and 18(B), smooth passage of the untransferred residual toner through a position between the blade-like member 21 and the photosensitive member 1 is achieved by reciprocating the blade portion 211 in the moving direction of the photosensitive member surface in accordance with the rotation of the photosensitive member.

The smear on the blade portion 211 caused by the toner or the like, which is charged to the opposite polarity and is attracted to the blade portion by the coulomb force, is removed by reciprocating the blade portion 211 in the surface moving direction of the photosensitive member in accordance with rotation of the photosensitive member. The blade portion 211 can slide on the photosensitive member surface to remove the smear thereon so that image noises caused by smear on the blade-like member, if any, can be suppressed.

As described above, the untransferred residual toner is collected by the developing/cleaning device. The untransferred residual toner reaching the blade-like member 21 contains foreign matters 100 (see FIG. 3) which adhered onto the photosensitive member 1 in the transfer portion and more specifically foreign matters such as paper powder adhered to the transfer sheet SH, and special coating material and adhesive applied to the surface of the transfer sheet.

Further, the distance between the foreign matter removing edge portion 200 of the blade portion 211 and the photosensitive member 1 is set to 200 $\mu$m or less even when the blade 211 is reciprocated, and the edge portion 200 is supplied with the negative voltage of the polarity opposite to that of the transfer voltage. This promotes electrostatic attraction of the foreign matters 100 to the edge portion 200, and thereby the foreign matters 100 are checked and scraped off by the foreign matter removing edge portion 200. Since the foreign matters are removed in this manner, noises such as black and blank spots which may be formed due to presence of the foreign matter can be suppressed, and thereby a good image can be obtained.

Figure 19:
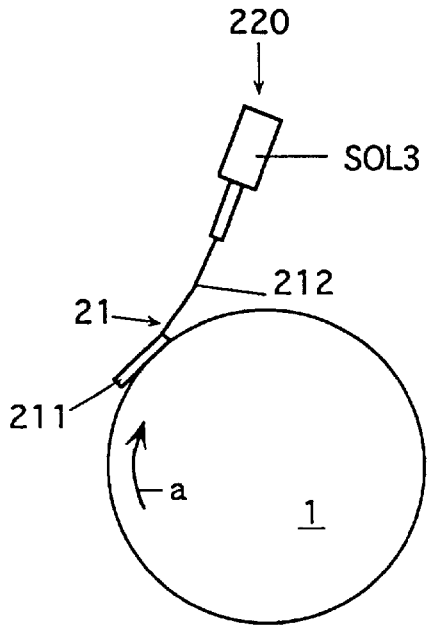
FIGS. 19 to 21 shows different examples of the auxiliary charging device also serving as the foreign matter removing device other than the above, respectively.
Figure 20:
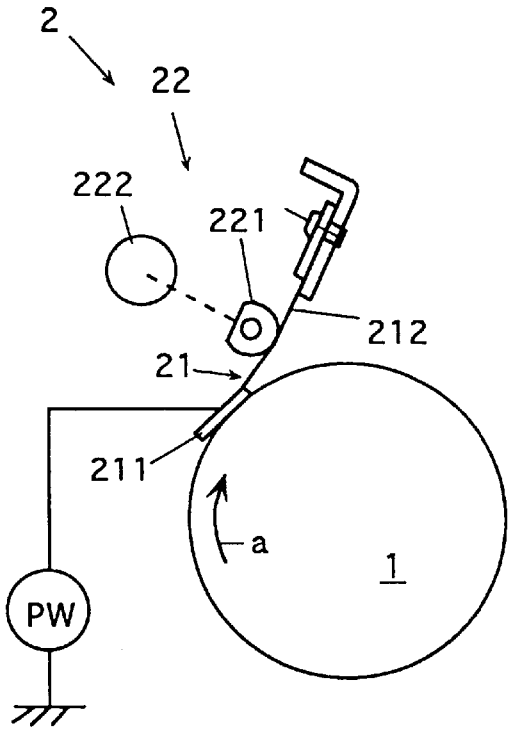

The auxiliary charging device 2 serving also as the foreign matter removing device employs the cam mechanism for driving the blade-like member 21. Alternatively, as shown in FIG. 19, a drive device 220 including a solenoid SOL3 may be employed for reciprocation of the member 21. Also, as shown in FIG. 20, such a structure may be employed that the AC power source PW applies an AC voltage to the blade-like member 21 in the charging device 2 for changing the electrostatic attraction force toward the photosensitive member 1 in accordance with the period of voltage application so that the blade-like member 21 vibrates and thereby the passage of the toner is facilitated. In this case, however, a major portion of the blade-like member 211 is formed of a material, for example, having a resistance value of $10^4$ Ωcm–$10^9$ Ωcm and containing a styrene elastomer and carbon particles dispersed therein.

Figure 21:
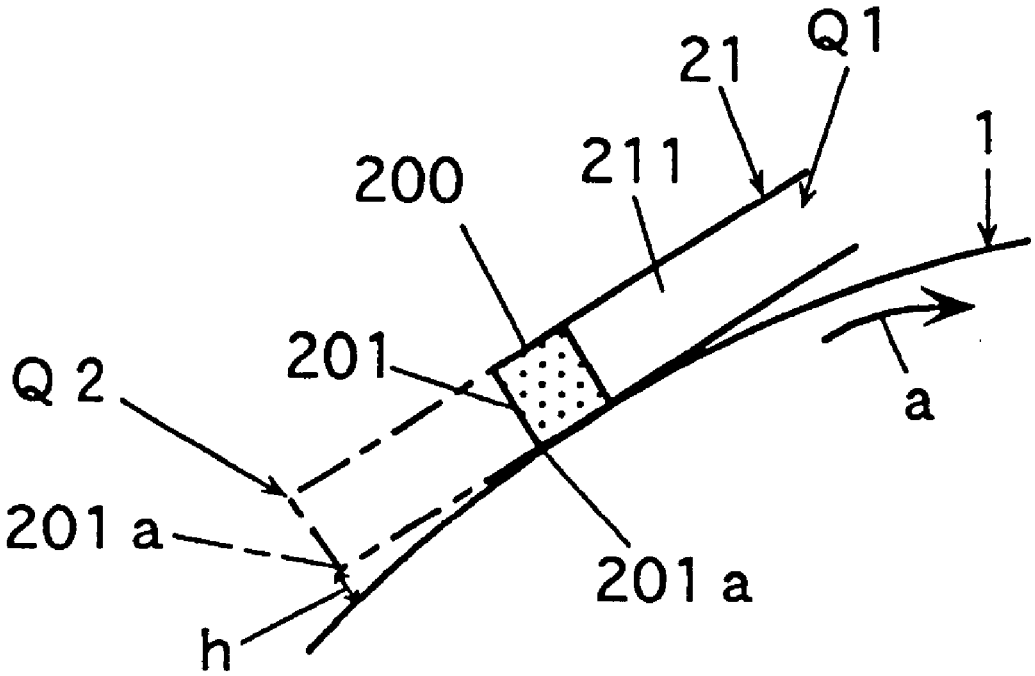

As shown in FIG. 21, the blade-like member 21 may be reciprocated between a position (i.e., a position Q1 represented by solid line in FIG. 21) where the edge 201*a* of the foreign matter removing edge portion 200 of the blade portion 211 is in contact with the photosensitive member 1 and a position (i.e., a position Q2 represented by broken line) where the foreign matter removing edge portion 200 projects upstream, in the moving direction of the image carrier surface, from the position Q1 with the space h of 200 μm or less (preferably, 100 μm or less and more preferably 50 μm or less) with respect to the image carrier. In this case, the drive device for the blade-like member 21 may employ the foregoing cam mechanism, the solenoid or the like. In the apparatus shown in FIG. 21, both the untransferred residual toner and the foreign matters are temporarily checked at the position Q1 by the foreign matter removing edge portion 200 (particularly, by its end surface 200), but the toner can pass through the position Q1 owing to reciprocation of the blade portion 211 between the positions Q1 and Q2.

The blade-like member 21 may be vibrated to bring the edge 201*a* into contact with the photosensitive member 1, for example, by applying the AC voltage to the blade portion from the AC power source.

Examples of the image forming apparatus employing the stationary foreign matter removing member have been described. Then, description will be given on image forming apparatuses employing the movable foreign matter removing member with reference to FIGS. 22(A) and 22(B). These figures show only major portions of the foreign matter removing device in the image forming apparatus. Other portions which are not shown in the figures are the same as those in the image forming apparatus shown in FIG. 16, and therefore will not be described below.

The photosensitive member used in the apparatus is negatively chargeable, and the developing/cleaning device 4 (see FIG. 16) uses negatively chargeable toner and performs reversal development. The power source 13 employed in the apparatus shown in FIG. 16 is replaced with a power source 130.

Figure 22A:
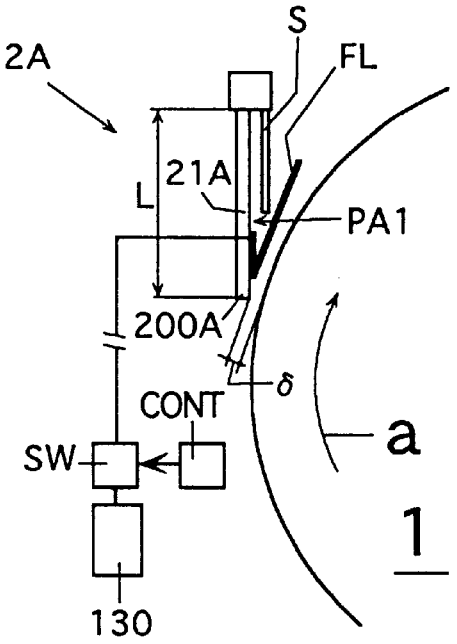
FIGS. 22(A) and 22(B) show still another example of the foreign matter removing device, and more specifically show a state that the foreign matter removing device is spaced from the photosensitive member and a state that the foreign matter removing device is in contact with the photosensitive member, respectively.
Figure 22B:
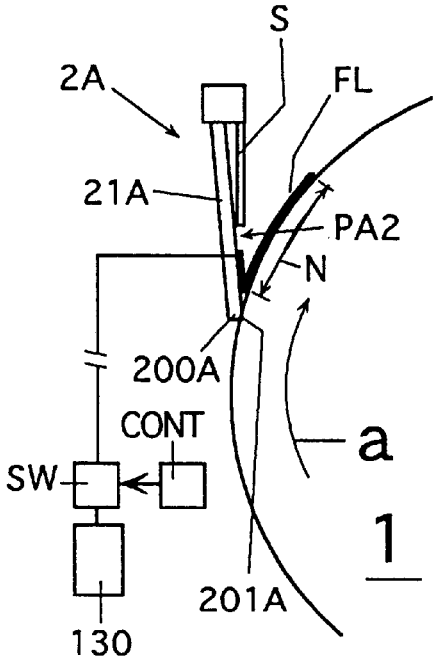

FIGS. 22(A) and 22(B) show a foreign matter removing device 2A and the photosensitive member 1. The foreign matter removing device 2A includes a foreign matter removing member 21A, a semiconductive member FL and anti-twist plate S, and further includes a switching device SW connected to the semiconductive member FL and a controller CONT for controlling the switching device SW. The switching device SW is connected to the power source 130. The switching device may be formed of a switching element arranged in the power source 130.

The foreign matter removing member 21A has a belt-like or blade-like form as a whole. The downstream end, in the moving direction a of the photosensitive member surface, is supported at a fixed position in a cantilever manner, and the free upstream end thereof forms a foreign matter removing edge 200A opposed to the photosensitive member 1. The foreign matter removing member 21A in this embodiment is made of polyurethane having a modulus of elasticity of 600 gf/mm$^2$, a thickness of 1 mm and a free length L of 20 mm.

In the state shown in FIG. 22(A), the foreign matter removing edge portion 200A is located at a spaced position PA1 retreated from the surface of the photosensitive member 1 by a space distance δ of about 0.5 mm. In the state shown in FIG. 22(B), the edge portion 200A is located at a foreign matter removing position PA2 where an edge 201A of the edge portion 200A near the photosensitive member 1 is contact with the photosensitive member. The semiconductive film FL is formed of a semiconductive film material made of fluororesin and electrically conductive carbon powder dispersed therein. The semiconductive member FL has a surface resistance of $10^4$ ohm/square(Ω/□)–$10^7$ ohm/square (Ω/□) and a thickness of about 100 μm, although not restricted thereto. The semiconductive film FL is folded at one end, which is adhered to and supported by the surface of the foreign matter removing member 21A. In this manner, the film FL is opposed to the photosensitive member 1.

The power source 130 also serves as a power source for the main charging device 3 (see FIG. 16) for uniformly charging the surface of the photosensitive member 1 for image formation. The power source 130 can supply a voltage of −1350 V to the main charging device 3 and the semiconductive film FL. Similarly to the power source 13 shown in FIG. 16, the power source 130 can apply the transfer voltage and the developing bias voltage. The power source is commonly used as described above so that the image forming apparatus can have a further simplified structure.

The anti-twist plate S has a larger rigidity than the foreign matter removing member 21A. The plate S is arranged at a position between the foreign matter removing member 21A and the photosensitive member 1, and neighbors to the foreign matter removing member 21A.

In the image forming apparatus employing the foreign matter removing device 2A shown in FIGS. 22(A) and 22(B), the visible image is formed on the photosensitive member 1 similarly to the image forming apparatus shown in FIG. 1. The visible toner image is transferred onto the transfer sheet SH (see FIG. 16) at the transfer portion, and is fixed. The foreign matters such as untransferred residual toner and paper powder remaining on the photosensitive member 1 after transfer of the visible toner image onto the transfer sheet reaches the foreign matter removing device 2A arranged between the transfer portion and the developing/cleaning device 4 (see FIG. 16).

In the foreign matter removing device 2A, the switching device SW applies the voltage supplied from the power source 130 for electrostatic attraction to the semiconductive film FL in accordance with the instruction from the controller CONT when the untransferred residual toner coming from the transfer portion have passed through the position under the foreign matter removing device 2A.

The controller CONT controls the switching device SW based on the instruction from the main controller which entirely controls the image forming apparatus.

By this application of the voltage, the semiconductive film FL is supplied with electric charges for electrostatic attraction, and thereby the film FL is attracted onto the surface of the photosensitive member 1 as shown in FIG. 22(B). In accordance with this, the foreign matter removing member 21A is pulled toward the photosensitive member 1 against its elastic restoring force, and is located at a foreign matter removing position PA2 where the edge 201A of the foreign matter removing edge portion 200A is in contact with the photosensitive member 1. The pressure of this contact is in a range from 0.5 gf/mm–0.8 gf/mm, and the mutual contact nip width N between the film FL and the photosensitive member 1 is 5 mm or more.

As a result of the attraction of the film FL to the photosensitive member 1, the film FL receives a pulling force in the surface moving direction of the photosensitive member, and thereby the anti-twist plate S prevents possible twist of the foreign matter removing member 21A.

Since the foreign matter removing member 21A is arranged at the foreign matter removing position PA2 as described above, the foreign matters such as special material, adhesive and paper powder adhering to the surface of the photosensitive member 1 are checked and scraped off by the member 21A.

Since the foreign matters are scraped off, image noises such as black and blank(white) spots which are liable to occur due to such foreign matters can be suppressed, and good images can be produced.

Upon elapsing of the predetermined timing for removal of the foreign matters, i.e., the time corresponding to one rotation of the photosensitive member 1, the switching device SW stops application of the voltage to the semiconductive film FL from the power source 130 based on the instruction from the controller CONT. This releases the electrostatic attraction force which acts to attract the semiconductive film FL to the photosensitive member 1 so that the foreign matter removing member 21A is moved away from the photosensitive member 1 by its elastic restoring force to the spaced position PA1 shown in FIG. 22(A), where it will stay until the next foreign matter removing timing.

The foreign matter removing device 2A can effectively suppress the damage to the photosensitive member 1, because the member 21A is not always in contact with the photosensitive member 1.

Since the semiconductive member FL is employed for driving the foreign matter removing member 21A, the foreign matter removing device 2A can have a simplified and inexpensive structure.

The untransferred residual toner is collected by the developing/cleaning device 4 prior to removal of the foreign matters by the foreign matter removing member 21A, as is done also by the image forming apparatus shown in FIG. 16.

Since the semiconductive film FL is supplied with the negative voltage when the foreign matters are to be removed, this voltage negatively charges the surface of the photosensitive member 1. Therefore, by stopping the application of voltage to the main charging device 3, the oppositely charged toner adhering to the charging brush roller 31 (see FIG. 16) is attracted toward the photosensitive member 1 and thereby the brush roller 31 can be cleaned up. In the foregoing embodiment, the foreign matter removing member 21A is kept in contact with the photosensitive member for the time corresponding to one rotation of the photosensitive member after the image formation. Alternatively, the foreign matter removing member 21A may be brought into contact with the photosensitive member 1 during the image formation, in which case the member 21A can function as precharging device for performing precharging prior to charging of the photosensitive member by the main charging device 3.

Figure 23:
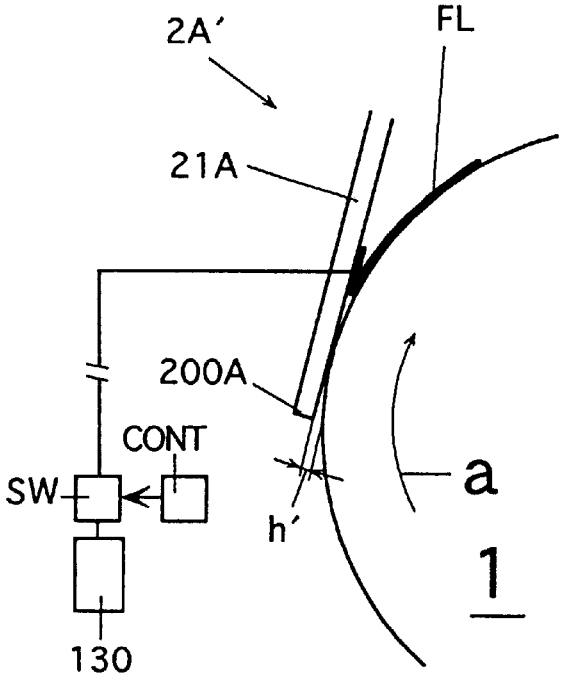
FIG. 23 shows further another example of the foreign matter removing device.

FIG. 23 shows a foreign matter removing device 2A' and the photosensitive member 1. The foreign matter removing device 2A' is a modification of the foreign matter removing device 2A shown in FIGS. 22(A) and 22(B), and differs therefrom in that the position of connection of the semiconductive film FL to the foreign matter removing member 21A is shifted to a certain extent so that the foreign matter removing edge 200A projects upstream, in the surface moving direction of the photosensitive member 1, to a certain extent when the semiconductive film FL is electrostatically attracted onto the photosensitive member 1 and the foreign matter removing member 21A is at the foreign matter removing position shown in FIG. 23. Structures other than above are the same as those of the device 2A described before. In the position shown in FIG. 23, a space distance h' of about 50 $\mu$m is kept between the foreign matter removing edge portion 200A and the surface of the photosensitive member 1. Thereby, the foreign matters can be checked and removed.

In this device 2A', the foreign matter removing edge portion 200A projects in a floating manner and more specifically with a space from the photosensitive member surface. Therefore, it is possible to suppress smear of the foreign matter removing edge portion 200A by toner and others adhering thereto. Also, it is possible to suppress such a problem that a large amount of untransferred residual toner instantaneously flows to cause a trouble at the main charging device 3 and others when the foreign matter removing member, which was in contact with the photosensitive member while the untransferred residual toner was present, is moved away from the photosensitive member.

(4) Fourth Type of the Image Forming Apparatus

The fourth type of the image forming apparatus is provided with a charge target member to be charged and a charging device charging the charge target member. The charging device includes a flexible and unrotational conductive charging member for applying electric charges to the charge target member, and the charging member has a leading edge to be pressed obliquely against the charge target member. The charging device also includes a pressing direction changing device for changing a direction of pressing of the unrotational conductive charging member against the charge target member.

In this embodiment, the unrotational conductive charging member has a sheet-like form (which may be called any name such as film or blade) or a brush-like form, but does not have a continuously rotational form such as a roller-like form.

The charge target member may typically be a rotational member, although not restricted thereto.

If the charge target member is a rotational member, the pressing direction changing device may be a rotation control device which can change the rotation direction of the charge target member and thereby can change the pressing direction of the unrotational conductive charging member.

In this case, the charge target member performs an ordinary operation in such a manner that the charge target member rotates to move its surface through a contact position with respect to the unrotational conductive charging member, and thereby charging or discharging is successively performed. Since the unrotational conductive charging member is flexible, its leading edge is pressed against the charge target member in the forward and oblique direction with respect to the rotation direction of the charge target member in the above operation. When the rotation control device, which is the pressing direction changing device, operates to reverse the rotation direction of the charge target member to rotate the same in the reverse direction, the leading edge of the unrotational conductive charging member following the charge target member changes its pressing direction. In this operation, adhered and deposited foreign matters drop from the contact portion of the leading edge of the unrotational conductive charging member, which was in contact with the charge target member, so that the contact portion is cleaned up. Thereby, the original charging performance is restored. Thereafter, the charge target member restarts the rotation in the original direction. Thereby, the leading edge of the flexible unrotational conductive charging member changes the pressing direction in accordance with the rotation direction. Thus, the normal state is restored.

In this example, the charge target member which is the rotational member may be a cylindrical member such as a drum. Alternatively, the charge target member may be a belt-like member retained around a plurality of rollers. More specifically, it may be a rotary member similar to an image carrier used for formation of an electrostatic latent image.

Regardless of whether the charge target member is a rotary member or not, such a structure may be employed that the unrotational conductive charging member is turnable around a shaft, and the pressing direction changing device is a turning control device which changes the pressing direction by turning the unrotational conductive charging member around the shaft.

In this structure, the charging device operates as follows. When the turning control device, i.e., the pressing direction changing device controls the unrotational conductive charging member to turn around the shaft, the pressing direction of its leading edge with respect to the charge target member changes. In this operation, the adhered and deposited foreign matters drop from the contact portion of the leading edge of the unrotational conductive charging member in contact with the charge target member so that the contact portion is cleaned up. Thereby, the original charging performance is restored. Thereafter, the turning control device controls the unrotational conductive charging member to the original or ordinary position so that the normal state is attained.

The word "turnable" in the above description is used to mean that turn around the shaft through only a predetermined angle is allowed. Therefore, continuous rotation is impossible.

Regardless of whether the charge target member is the rotary member or not, the pressing direction changing device may be a pushing device which pushes or presses the unrotational conductive charging member in the circumferential or surface direction of the charge target member.

This charging device operates as follows. When the pushing device, i.e., the pressing direction changing device pushes the unrotational conductive charging member in the circumferential or surface direction of the charge target member, the pressing direction of its leading edge with respect to the charge target member changes. In this operation, the adhered and deposited foreign matters drop from the contact portion of the leading edge of the unrotational conductive charging member in contact with the charge target member so that the contact portion is cleaned up. Thereby, the original charging performance is restored. Thereafter, the pressing direction changing device releases the pressure so that the unrotational conductive charging member returns to the original position, and the normal state is attained.

In any one of the foregoing structures of the image forming apparatuses, a foreign matter collecting device may be employed for collecting the foreign matters which drop when the pressing direction of the unrotational conductive charging member changes.

In this apparatus, when the pressing direction changing means changes the pressing direction of the leading edge of the unrotational conductive charging member with respect to the charge target member, the foreign matters dropped therefrom are collected by the foreign matter collecting device. Therefore, the dropped foreign matters are prevented from smearing another portion.

In any one of the foregoing structures of the image forming apparatuses, it is desirable to employ a voltage applying device for applying a voltage to the unrotational conductive charging member so that the voltage applying device applies the voltage at the time of change of the pressing direction of the unrotational conductive charging member. It is desirable that this voltage is an AC voltage, a DC voltage of the same polarity as the foreign matters, or both of them superposed together. This is because the leading edge of the unrotational conductive charging member vibrates with respect to the charge target member as a result of application of an AC voltage at the time of change of the pressing direction of the unrotational conductive charging member, and this vibration promotes dropping of the foreign matters. When the DC voltage of the same polarity as the foreign matters is applied, the Coulomb force acts to release the foreign matters from the unrotational conductive charging member, and thereby promotes dropping of the foreign matters. The voltage applying device in this example may be employed also as a device which applies a bias voltage to the unrotational conductive charging member for applying electric charges to the charge target member.

A specific example of the image forming apparatus of the fourth type will be described below with reference to the drawings.

Figure 27:
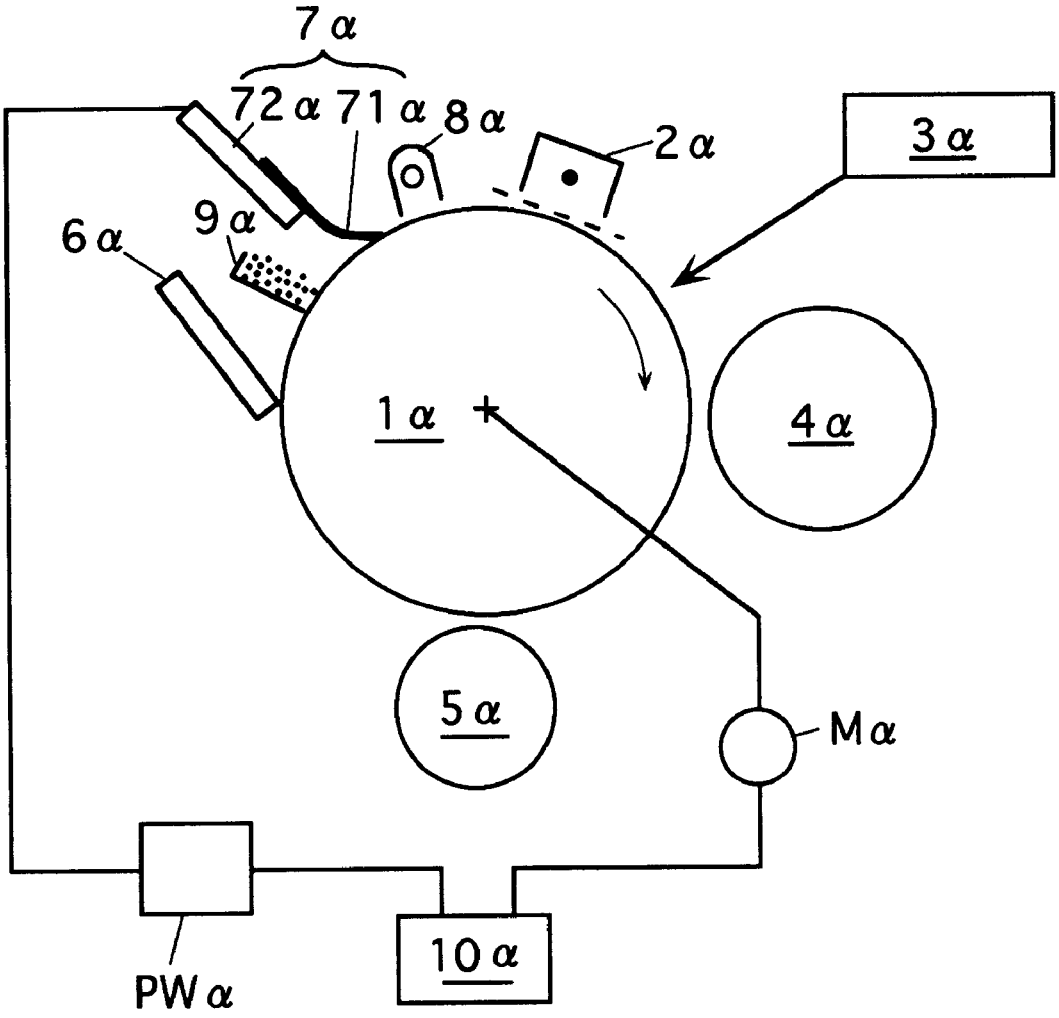
FIG. 27 shows a schematic structure of an example of an image forming apparatus of a fourth type according to the invention.

FIG. 27 shows a schematic structure of an electrophotographic image forming apparatus used in a copying machine, a printer, a facsimile machine or the like. This image forming apparatus includes a cylindrical photosensitive drum 1α as well as a charger 2α, a laser exposing device 3α, a developing device 4α, a transfer device 5α, a cleaner 6α, a charging device 7α, a photo-discharging device 8α and a foreign matter tray 9α arranged around the drum 1α. The apparatus also includes a controller 10α for entire control of the apparatus.

The photosensitive drum 1α is provided at its surface with a photosensitive layer, and is driven to rotate by a motor Mα. For the image formation. The photosensitive drum 1α rotates clockwise in the figure under the control by the controller 10α, although reverse rotation is also allowed as will be described later. The charger 2α is supplied with a voltage from a power source (not shown) for charging the photosensitive layer of the photosensitive drum 1α to a predetermined potential, and is provided with a grid for controlling the charged potential. The laser exposing device 3α can irradiate laser beams based on image data to the photosensitive layer, which is already charged to the predetermined potential by the charger 2α, for forming an electrostatic latent image. The developing device 4α is provided for applying toner to the electrostatic latent image on the photosensitive drum 1α for forming a toner image, and allows supply, agitation and circulation of the toner. The transfer device 5α is supplied with the voltage from the power source (not shown) for transferring the toner image on the photosensitive drum 1α onto a record target member such as a printing paper sheet, which will be referred to merely as a "printing sheet". The transfer device 5α applies to the photosensitive drum 1α an electric field of a polarity opposite to that applied to the photosensitive drum 1α by the charger 2α. Although not shown, the apparatus is further provided with a sheet feeding system for feeding printing sheets to a position between the transfer device 5α and the photosensitive drum 1α as well as a fixing device (not shown) for fixing the toner image on the printing sheet and a sheet discharge system (not shown) for discharging the printing sheet after the fixing. In view of the above, the photosensitive drum 1α can be deemed as an image carrier which serves to carry the toner image from the developing device 4α to the transfer device 5α.

The cleaner 6α is provided for removing the toner remaining on the surface of the photosensitive drum 1α after the transfer so as to prevent smearing of an image formed in the next operation. The charging device 7α and photo-discharging device 8α are provided for reducing the degree of irregularities in potential, which occurs on the surface of the photosensitive drum 1α charged by the transfer device 5α and more specifically is caused, for example, by inversion of the polarity, before the surface reaches the charger 2α. The charging device 7α is formed of an electrically conductive sheet member (charging member) 71α, which is formed of a sheet-like flexible member of about 0.1 mm in thickness having an electrical conductivity and a surface resistance of about $10^3$ ohm/square–$10^9$ ohm/square, and a holder 72α holding the member 71α. A leading edge of the conductive sheet member 71α is pressed against the photosensitive drum 1α in a direction inclined and following the rotating direction of the drum 1α. The conductive sheet member has a portion which projects from the holder 72α and has a free length of 10 mm to 20 mm. The conductive sheet member 71α receives the bias voltage from a power source PWα, and thereby applies charges to the photosensitive drum 1α for uniformizing the potential. In particular, the major purpose of the charging device 7α is to pull up the potential on a portion of the surface of the photosensitive drum 1α, where its potential is inverted by the transfer device 5α, to the potential of the intended polarity. For this, the device 7α is supplied with the bias voltage (either the DC or AC voltage, or both of them in the superposed manner) from the bias power source PWα connected to the controller 10α. The photo-discharging device 8α is provided for removing unnecessary charges from the surface of the photosensitive drum 1α by radiating light beams to the surface. The foreign matter tray 9α is provided for collecting the foreign matters released from the contact portions of the conductive sheet member 71α and the photosensitive drum 1α.

The controller 10α provided for total control is a microcomputer formed of known parts and units such as a CPU, a ROM and a RAM, and has various functions including functions of controlling drive and rotation of the photosensitive drum 1α and application of the bias voltage to the conductive sheet member 71α. These will be described later more in detail. The controller 10α also performs control of various devices such as the charger 2α, the developer 4α and others.

The image forming apparatus having the above structure performs the image formation as described below. The photosensitive drum 1α rotates clockwise in the figure (this rotation will be referred to as a "positive rotation" hereinafter). Thereby, the photosensitive layer at the surface thereof is charged to a predetermined potential when it passes through the charger 2α. The portion of the photosensitive layer carrying the predetermined charged potential is irradiated with the laser beam in accordance with the image information when it reaches the laser exposure device 3α in accordance with rotation of the photosensitive drum 1α, so that an electrostatic latent image is formed at the charged portion. When the electrostatic latent image reaches the developing device 4α in accordance with rotation of the photosensitive drum 1α, it is supplied with the toner so that the toner image is formed. Thereafter, the photosensitive drum 1α will rotate, carrying the toner image on its surface.

When the toner image reaches the transfer device 5α, the transfer device 5α applies a transfer electric field to the photosensitive drum 1α so that the toner image is attracted and transferred onto the record sheet. The above transfer electric field has a polarity opposite to that of the electric field which is applied to the photosensitive drum 1α for charging the photosensitive drum 1α by the charger 2α. Therefore, the potential of the photosensitive layer changes due to the influence thereof, and one or some portions may carry the potential of the polarity opposite to that attained by the charging by the charger 2α. Even after passage through the transfer device 5α, a small amount of toner remains at the portion on the photosensitive drum 1α where the toner image was carried. When the residual toner reaches the cleaner 6α, it is scraped off and removed by the cleaner 6α.

Figure 28:
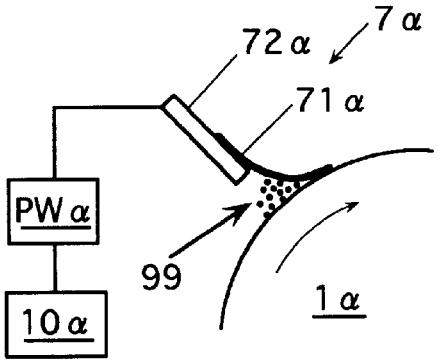
FIG. 28 shows a structure near the charging device in the image forming apparatus shown in FIG. 27.

When the surface portion reaches the conductive sheet member 71α, it is supplied with charges, and is irradiated with light beams from the photo-discharging device 8α. Thereby, the portion bearing the potential, which was inverted when it passed through the transfer device 5α, is restored to carry the potential of the original polarity, which is adjusted not to exceed the predetermined value of the voltage to be charged by the charger 2α. If a portion carrying the potential of the inverted polarity and/or a portion carrying a potential exceeding in value the potential to be charged by the charger 2α were present, it would be impossible to restore the potentials on these portions to the predetermined potential, resulting in noises on an image formed in the next processing. Foreign matters 99 such as paper powder, toner and material of the photosensitive layer may be adhered and deposited on the contact portion of the conductive sheet 71α in contact with the photosensitive drum 1α as shown in FIG. 28. Therefore, a cleaning operation for removing them is performed within a period other than image formation.

Upon next arrival at the charger 2α, charging to the predetermined potential is performed again so that the next image formation is enabled. In connection with this, the conductive sheet member 71α and the photo-discharging device 8α perform the potential adjustment prior to charging by the charger 2α, and thereby there is no portion where the polarity is inverted or the voltage value is larger than the predetermined value so that charging is performed highly uniformly, and the produced image can have a high quality. The above operations are performed under the control by the controller 10α.

Description will now be given on the removal of the foreign matters 99 (FIG. 28) deposited on the contact portions of the conductive sheet member 71α and the photosensitive drum 1α. As already described, if the image formation were performed without removing the adherent foreign matters 99 deposited on the contact portions, variations and irregularities occur in the charging performance of the conductive sheet member 71α. According to a test, visible stripe noises appeared on an image if image formation was performed on thousands of sheets without any cleaning.

Figure 29:
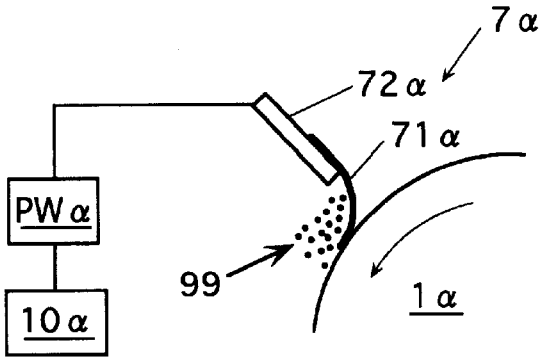
FIG. 29 shows a state of an operation for removing foreign matters by reversely rotating a photosensitive drum.

For cleaning and removal of the deposited foreign matters 99, the controller 10α in this embodiment controls the photosensitive drum 1α to rotate counterclockwise in FIG. 27 (this rotation will be referred to as a "reverse rotation" hereinafter), i.e., in the direction opposite to that during the image formation, and also performs the control to apply a voltage to the conductive sheet member 71α. The applied voltage is formed of a DC voltage of the same polarity as the chargeable polarity and an AC voltage superposed thereon. Thereby, as shown in FIG. 29, the leading edge of the conductive sheet member 71α changes its position to follow the reverse rotation of the photosensitive drum 1α, and the pressing direction is inverted from that shown in FIG. 27. Owing to this repulsion at the time of shift of position, the foreign matters 99 drop and the conductive sheet member 71α is cleaned up. At this time, the DC component of the voltage applied to the conductive sheet member 71α produces a Coulomb force acting to release the foreign matters from the conductive sheet member 71α so that the cleaning can be performed very efficiently. The AC component of the applied voltage releases the electrostatic attraction of the leading edge of the conductive sheet member 71α toward the photosensitive drum 1α, and vibrates the same. This vibration also promotes drop of the foreign matters 99, and therefore improves the cleaning efficiency. The dropped foreign matters 99 are collected to the foreign matter tray 9α.

In the above operation, the photosensitive drum 1α is required to rotate reversely only to an extent which can change the pressing direction of the conductive sheet member 71α, and therefore the extent of about 20 mm–50 mm in circumferential length is enough for this purpose. In the rotation angle, the extent of about 10 to 30 degrees can achieve the sufficient return. Naturally, this cleaning by reverse rotation of the photosensitive drum 1α is performed while the image formation is not performed. After the cleaning, the photosensitive drum 1α is positively rotated so that the leading edge of the conductive sheet member 71α changes and returns its direction to the pressing direction shown in FIG. 27 in accordance with the position rotation of the photosensitive drum 1α. In this state, the image formation is performed. Since the conductive sheet member 71α is flexible, the photosensitive drum 1α is not damaged when the pressing direction changes.

As described above, the photosensitive drum 1α rotates in the direction opposite to that for the image formation so that the pressing direction of the conductive sheet member 71α with respect to the photosensitive drum 1α changes. At the same time, the voltage is applied to the conductive sheet member 71α. Therefore, the foreign matters 99 deposited on the contact portions between the conductive sheet member 71α and the photosensitive drum 1α drop therefrom owing to the repulsion caused by the direction change, the vibration and the Coulomb repulsive force so that the conductive sheet member 71α is cleaned up. By performing this cleaning with an adequate frequency, the image forming apparatus can produce images of a high quality without causing irregularities and variations in charging performance of the charging device 7α even after a long use. Since the foreign matter tray 9α for collecting the dropped foreign matters 99 is employed, smearing of another portion by the dropped foreign matters 99 is prevented.

In this embodiment, the conductive member of the charging device 7α has a sheet-like form, but may have a brush-like form. The DC and AC voltages are applied in a superposed manner to the conductive sheet member 71α when the photosensitive drum 1α is reversely rotated. Alternatively, a voltage containing either the DC or AC component may be employed for achieving the effect. Further, the cleaning may be performed only by the reverse rotation of the photosensitive drum 1α without applying the voltage, in which case the effect can be obtained to a certain extent. The foreign matter tray 9α may be replaced with, e.g., adhesive tape.

The charging member 7α is used together with the photo-discharging device 8α in the above embodiment. However, the photo-discharging device 8α may be eliminated and the photosensitive drum 1α can be discharged only by the charging device 7α. Alternatively, the charging device 7α may be employed as the charger. The embodiment described above employs the reversal development system in which the transfer device 5α applies the electric field of the polarity opposite to that by the charging device 2α. However, the normal development system may be employed.

Figure 30:
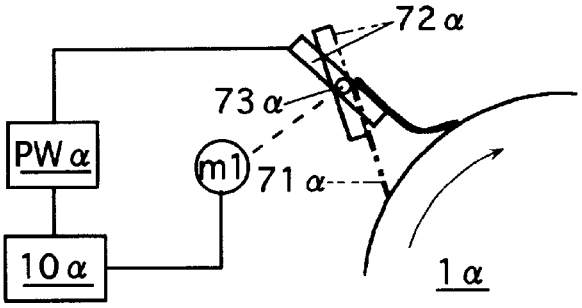
FIGS. 30 to 32 shows structures near charging devices of different examples of the image forming apparatus of the fourth type other than the above, respectively.
Figure 31:
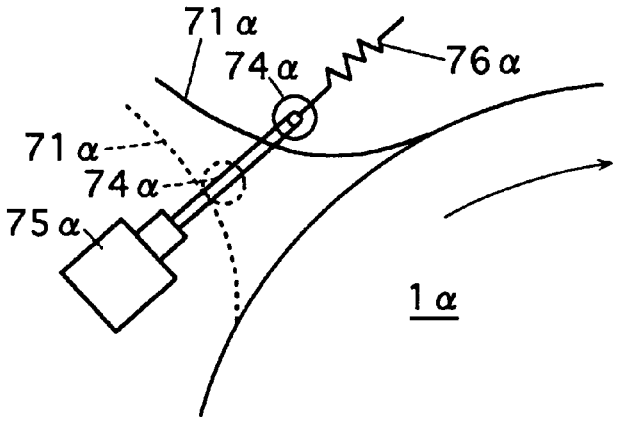
Figure 32:
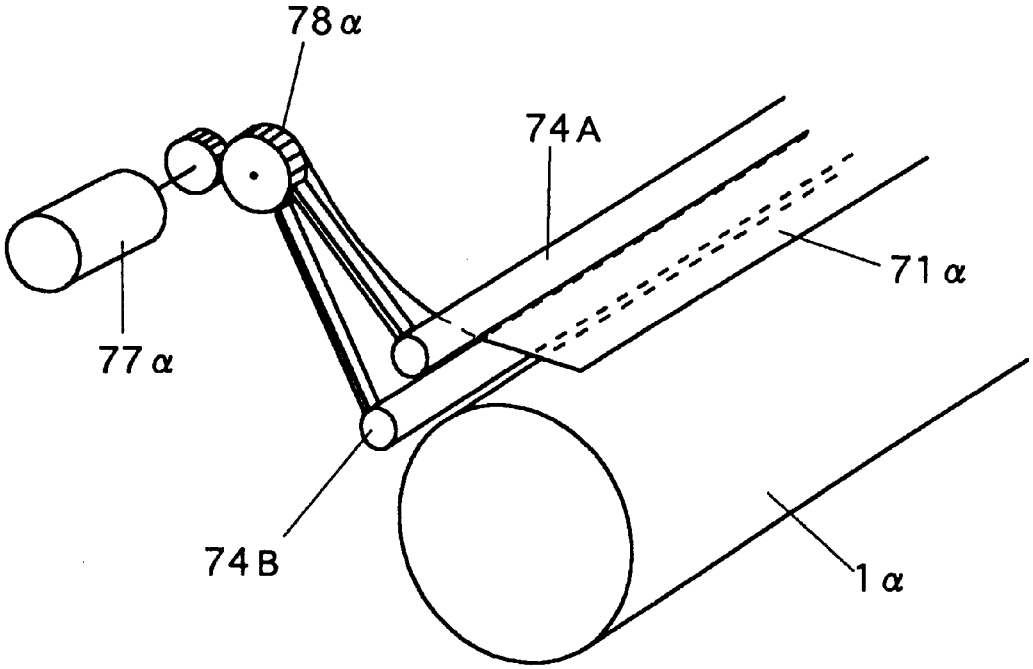

In addition to the structure already described, the charging device 7α may employ structures shown in FIGS. 30 to 32.

The charging device shown in FIG. 30 differs from the charging device 7α shown in FIG. 27 in that the holder 72α is turnably carried by a shaft 73 for turing the conductive sheet member 71α together with the holder 72α. The holder 72α is turned by a motor m1 controlled by the controller 10α.

The charging device shown in FIG. 30 attains the state shown by solid line in FIG. 30 during the normal image forming operation. More specifically, the leading edge of the conductive sheet member 71α is pressed against the photosensitive drum 1α in the direction following the positive rotation of the drum 1α. The pressed state is the same as that shown in FIG. 28, and the image formation is performed with this state.

When removing the foreign matters 99 deposited on the contact portions of the conductive sheet member 71α and the photosensitive drum 1α for cleaning, the holder 72α turns around the shaft 73α under the control by the controller 10α, and the holder 72α and the conductive sheet member 71α attain the state represented by broken lines in FIG. 30. At the same time, the voltage is applied to the conductive sheet member 71α similarly to the operation of the charging device shown in FIG. 27. In the state represented by the broken line in FIG. 30, the leading edge of the flexible conductive sheet 71α is pressed against the photosensitive drum 1α in the changed direction, and repulsion caused by this change in direction and application of the voltage act to drop the foreign matters 99 similarly to the operation by the charging device in FIG. 27 so that the conductive sheet member 71α is cleaned up. The dropped foreign matters 99 are collected into the foreign matter tray 9α. After the cleaning, the holder 72α is turned reversely to the former position shown by solid line in FIG. 30. Continuous rotation of the holder 72α is not required because it is necessary only to select the states represented by the solid line and the broken line in FIG. 30. When the holder 72α moves from the position shown by the solid line in FIG. 30 to the position shown by the broken line, the photosensitive drum 1α may be stopped, or may be reversely rotated in synchronization with the turn of the holder 72α. Naturally, the cleaning by turn of the holder 72α is performed when the image formation is not performed.

As described above, the holder 72α holding the conductive sheet member 71α is turned to change the pressing direction of the conductive sheet member 71α against the photosensitive drum 1α. Also, the voltage is applied to the conductive sheet member 71α. Thereby, the foreign matters 99 deposited on the contact portions of the conductive sheet member 71α and the photosensitive drum 1α drop owing to the repulsion by the change in pressing direction, the vibration and the Coulomb repulsive force. Therefore, the conductive sheet member 71α is cleaned up. Accordingly, by performing this cleaning with adequate frequency, the image forming apparatus can produce images of a high quality without variations and irregularities in charging performance of the charging device even after a long use.

In this embodiment, the axis or shaft 73α of the holder 72α is arranged at a center of the holder 72α. However, the shaft 73α may be arranged at another position and, for example, may be arranged at one or the other end of the conductive sheet member 71α.

Similarly to the charging device in FIG. 27, the conductive charging member may have a brush-like form instead of the sheet-like form. During the cleaning, a voltage containing only the DC or AC component may be applied to the conductive sheet member 71α, or application of the voltage may be eliminated. The foreign matter tray 9α may be replaced with, e.g., adhesive tape. The photo-discharging device 8α may be eliminated. The charging device may be used also as the charger. The normal development system may be employed instead of the reversal development system. Other modifications employable in the former embodiment can also be employed in this embodiment.

A charging device shown in FIG. 31 is provided with a pressing member 74α at a position downstream, in the normal rotating direction of the photosensitive drum 1α, from the conductive sheet member 71α. The structure does not differ from the charging device in FIG. 27 in other points. The solenoid 75α is controlled by the controller 10α.

In this embodiment, the conductive sheet member 71α is in the position shown by solid line in FIG. 31 during the normal image forming operation. In this state, the solenoid 75α is off so that the pushing member 74α is pulled by a tension spring 76α away from the solenoid 75α. When the photosensitive drum 1α rotates in the normal direction for image formation, the leading edge of the conductive sheet member 71α follows it and is pressed against the photosensitive drum 1α in the same pressing direction as that in FIG. 28. In this state, the image formation is performed.

When the cleaning is performed for removing the foreign matters 99 deposited on the contact portions of the conductive sheet member 71α and the photosensitive drum 1α, the controller 10α turns on the solenoid 75α to attract the pushing member 74α so that the conductive sheet member 71α is pushed against the pushing member 74α to set the conductive sheet member 71α to the state shown by broken line in FIG. 31. At the same time, the voltage is applied to the conductive sheet member 71α similarly to the operation of the charging device shown in FIG. 27. In the state shown by the broken line in FIG. 31, the leading edge of the flexible conductive sheet member 71α is pressed against the photosensitive drum 1α in the changed direction. Thereby, the foreign matters 99 drop owing to the repulsion at the time of change in direction and the action of the applied voltage, as is done also in the charging device shown in FIG. 27, so that the conductive sheet member 71α is cleaned. The dropped foreign matters 99 are collected onto the foreign matter tray 9α. After the cleaning, the solenoid 75α is turned off, and the state shown by the solid line in FIG. 31 is restored by the tension spring 76α. When the solenoid 75α is turned on to move the conductive sheet member 71α from the position shown by the solid line in FIG. 31 to the position shown by the broken line, the photosensitive drum 1α may be stopped, or may be reversely rotated in synchronization with the operation of the solenoid 75α. Naturally, the cleaning by operating the solenoid 75α is performed when the image formation is not performed.

According to the embodiment described above, the solenoid 75α drives the pushing member 74α to push the same against the conductive sheet member 71α, and thereby the conductive sheet member 71α is pressed against the photosensitive drum 1α in the changed direction. At the same time, the voltage is applied to the conductive sheet member 71α. Therefore, the foreign matters 99 deposited on the contact portions of the conductive sheet member 71α and the photosensitive drum 1α drop owing to the repulsion at the time of change in direction, the vibration and the Coulomb repulsive force so that the conductive sheet member 71α is cleaned. Accordingly, by performing this cleaning with adequate frequency, the image forming apparatus can produce images of a high quality without variations and irregularities in charging performance of the charging device even after a long use.

For example, the positional relationship and the operation characteristics of the solenoid 75α and the tension spring 76α may be inverted. Even in this case, a similar effect can be achieved. The modifications already described with reference to the charging device shown in FIG. 27 can also be employed in this embodiment.

A charging device shown in FIG. 32 is provided with pushing members 74A and 74B at the opposite sides of the conductive sheet member 71α. These members 74A and 74B are pivotable while keeping a constant angle around a fulcrum shaft 78α. A motor 77α is employed for rotating the fulcrum shaft 78α. This charging device differs from the charging device shown in FIG. 31 only in that the device employs the two pushing members, which hold the opposite sides of the conductive sheet member 71α, and does not employ a tension spring. Thus, the motor 77α is driven to rotate the fulcrum shaft 78α for changing the positions of the pushing members 74A and 74B. Thereby, the conductive sheet member 71α can be selectively set to the pressing state corresponding to that shown in FIG. 28 and the pressing state corresponding to that shown in FIG. 29. The motor 77α is controlled by the controller 10α.

In the normal image forming operation by this charging device, the controller 10 controls the motor 77α to drive, and the pushing member 74B pushes downstream the conductive sheet member 71α to press the same against the photosensitive drum 1 and thereby attain the same pressing state as that shown in FIG. 28. The image formation is performed in this state.

In the cleaning operation of removing the foreign matters 99 deposited on the contact portions of the conductive sheet member 71α and the photosensitive drum 1α, the controller 10α drives the motor 77α to push the pushing member 74A upstream to the conductive sheet member 71α so that it is pressed against the photosensitive drum 1 to attain the same pressed state as that shown in FIG. 29. At the same time, the voltage is applied to the conductive sheet member 71α, as is done also in the charging device shown in FIG. 27. In this state, the leading edge of the flexible conductive sheet member 71α is pressed against the photosensitive drum 1α in the changed direction. Thereby, the foreign matters 99 drop owing to the repulsion at the time of change in direction and the action of the applied voltage, as is done also in the charging device shown in FIG. 27, so that the conductive sheet member 71α is cleaned. The dropped foreign matters 99 are collected onto the foreign matter tray 9α. After the cleaning, the motor 77α is turned off, and the pushing member 74α restores the state for pushing upstream the conductive sheet member 71α. When the motor 77α is activated to change the pressing direction of the conductive sheet member 71α against the photosensitive drum 1α, the photosensitive drum 1α may be stopped, or may be reversely rotated in synchronization with the operation of the motor 77α. Naturally, the cleaning by operating the motor 77α is performed when the image formation is not performed.

According to the charging device described above, the motor 77α drives the pushing member 74A to push the same upstream against the conductive sheet member 71α, and thereby the conductive sheet member 71α is pressed against the photosensitive drum 1α in the changed direction. At the same time, the voltage is applied to the conductive sheet member 71α. Therefore, the foreign matters 99 deposited on the contact portions of the conductive sheet member 71α and the photosensitive drum 1α drop owing to the repulsion at the time of change in direction, the vibration and the Coulomb repulsive force so that the conductive sheet member 71α is cleaned. Accordingly, by performing this cleaning with adequate frequency, the image forming apparatus can produce images of a high quality without variations and irregularities in charging performance of the charging device even after a long use.

The modifications already described with reference to the charging device shown in FIG. 27 can also be employed in this embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a charging device opposed to a moving surface of an image carrier, said charging device including a charging member to be supplied with a charging voltage and having a smooth surface opposed to said image carrier, and said smooth surface of said charging member contributing to discharging to said image carrier;

a support member for supporting said charging member and holding a portion of said smooth surface in contact with said image carrier; and a charging member drive device for moving said support member to thereby cause the portion of said smooth surface to no longer be in contact with said image carrier and to cause a different portion of said smooth surface to be in contact with said image carrier, wherein said charging member drive device reciprocates the portion of said smooth surface to be in and out of contact with said image carrier during a cleaning operation.

2. The image forming apparatus according to claim 1, wherein said portion of the smooth surface which is out of contact with the image carrier discharges to the image carrier while the portion of the smooth surface which is in contact with the image carrier is cleaned.

3. The image forming apparatus according to claim 2, wherein said charging member is a sheet-like charging member.

4. The image forming apparatus according to claim 2, wherein the maximum distance between the portion of said smooth surface which is out of contact with said image carrier and said image carrier surface is set to be equal to or larger than a distance causing discharging with a minimum discharge voltage according to Pashen's law.

5. The image forming apparatus according to claim 2, wherein said charging member is a flexible sheet-like charging member having an elastic restoring property, and said charging member drive device includes a cam for pressing said charging member against said image carrier and for reciprocating the portion of said charging member to be in and out of contact with said image carrier by utilizing the elastically restoring force of said charging member.

6. The image forming apparatus according to claim 1, wherein said cleaning operation is executed while the surface of said image carrier is moving.

7. The image forming apparatus according to claim 1, wherein said cleaning operation is executed out of image formation periods.

8. The image forming apparatus according to claim 1, wherein said cleaning operation is executed prior to image formation.

9. An electrophotographic image forming apparatus of a cleanerless type comprising:

a plurality of contact members in contact with a surface of an image carrier, wherein one of said plurality of contact members shaves said image carrier surface to the highest extent and has a contact surface in contact with the image carrier surface, said contact surface of said one of said plurality of contact members having a high smoothness compared with the other of said plurality of contact members.

10. The image forming apparatus according to claim 9, wherein said image carrier is an organic photosensitive member.

11. The image forming apparatus according to claim 9, wherein said surface of said contact member shaving said image carrier surface to the highest extent and being in contact with said image carrier surface has a surface roughness of about 5 μm or less in Rz.

12. The image forming apparatus according to claim 9, wherein said image carrier surface is shaved to have the surface roughness of 200 μm or more in Sm and 3 μm or less in Rz.

13. The image forming apparatus according to claim 9, wherein said image carrier surface is shaved to have such a surface roughness that a difference in surface roughness between minute surface portions spaced by 30 μm from each other, in the image carrier surface direction, at various positions of said image carrier surface is set to 0.6 μm or less.

14. The image forming apparatus according to claim 9, further comprising:

a member drive device for reciprocating, along said image carrier surface, said one of said plurality of contact members.

15. The image forming apparatus according to claim 14, wherein said member drive device reciprocates said one of said plurality of contact members through a distance larger than the contact nip width between said contact member and said image carrier.

16. The image forming apparatus according to claim 14, wherein said one of said plurality of contact members is a blade-like member.

17. The image forming apparatus according to claim 14, wherein said member drive device repetitively reciprocates said one of said plurality of contact members during movement of said image carrier.

18. The image forming apparatus according to claim 14, wherein said member drive device drives said one of said plurality of contact members in accordance with timing, other than that during image formation.

19. The image forming apparatus according to claim 14, wherein said member drive device drives said one of said plurality of contact members in accordance with timing of a predetermined operation performed on the image forming apparatus.

20. An electrophotographic image forming apparatus comprising:

a developing/cleaning device for performing simultaneous development and cleaning of toner remaining on an image carrier having a moving surface after transfer onto a transfer target member of a visible toner image formed on said moving surface;

a foreign matter removing device arranged at a section defined in the moving direction of said moving surface between a transfer portion and said developing/cleaning device, wherein said foreign matter removing device includes a foreign matter removing member having a foreign matter removing edge portion opposed to said moving surface, and said foreign matter removing edge portion is located at a distance ranging from 0 to 200 $\mu$m from said moving surface.

21. The image forming apparatus according to claim 20, wherein said foreign matter removing edge portion of said foreign matter removing member has a hardness of 40 degrees or more at least at the foreign matter checking end surface faced in the moving direction of said image carrier surface.

22. The image forming apparatus according to claim 20, wherein said foreign matter removing edge portion of said foreign matter removing member has an edge neighboring and opposed to said image carrier and having a sectional contour of 100 $\mu$m or less in curvature radius.

23. The image forming apparatus according to claim 20, wherein said foreign matter removing member is in contact with the image carrier with a pressure in a range from 0.05 g/mm to 10.0 g/mm.

24. The image forming apparatus according to claim 20, wherein said foreign matter removing member is supplied with an electrostatic attraction voltage of a polarity opposite to that of the transfer voltage applied at said transfer portion, and the foreign matter removing edge portion of said foreign matter removing member has at least the foreign matter checking end surface faced in the moving direction of said image carrier surface and having a resistance value of $10^4$ Ωcm–$10^{10}$ Ωcm.

25. The image forming apparatus according to claim 20, wherein a foreign matter checking end surface of said foreign matter removing edge portion of said foreign matter removing member faced in the moving direction of said image carrier surface is made of a material having an SP value close to an SP value of the foreign matters.

26. The image forming apparatus according to claim 20, wherein said foreign matter removing member is in contact with said image carrier surface through its portion downstream, in the moving direction of the image carrier surface, from said foreign matter removing edge portion, and said foreign matter removing edge portion projects upstream in the moving direction of the image carrier surface or less space of 200 $\mu$m or less with respect to said image carrier.

27. The image forming apparatus according to claim 26, wherein said foreign matter removing device is provided with a drive device for reciprocating said foreign matter removing member along the image carrier surface while keeping the projected state of said foreign matter removing edge portion.

28. The image forming apparatus according to claim 26, wherein said foreign matter removing device includes a drive device for moving said foreign matter removing member toward and away from said image carrier surface.

29. The image forming apparatus according to claim 20, wherein said foreign matter removing device includes a device for reciprocating said foreign matter removing member between a position where an edge of the foreign matter removing edge portion near said image carrier is in contact with said image carrier surface and a position where said foreign matter removing edge portion projects upstream in the moving direction of the image carrier surface with a space of 200 $\mu$m or less with respect to said image carrier.

30. The image forming apparatus according to claim 20, wherein said foreign matter removing device includes a device for reciprocating said foreign matter removing member between a position where an edge of the foreign matter removing edge portion near said image carrier is in contact with said image carrier surface and a position where the whole edge portion is spaced therefrom to locate the edge a distance of 200 $\mu$m or less from said image carrier.

31. An image forming apparatus comprising:

a charge target member to be charged; and a charging device for charging said charge target member, said charging device includes a flexible and unrotational conductive charging member for applying electric charges to said charge target member, and said charging member has a leading edge to be pressed obliquely against said charge target member for charging; and a pressing direction changing device for changing a direction of pressing of said unrotational conductive charging member against said charge target member.

32. The image forming apparatus according to claim 31, wherein said charge target member is a rotational member, and said pressing direction changing device is a rotation control device for changing the rotation direction of said charge target member and thereby changing the pressing direction of said unrotational conductive charging member.

33. The image forming apparatus according to claim 31, wherein said unrotational conductive charging member is turnable around a shaft, and said pressing direction changing device is a turning control device for changing the pressing direction by turning said unrotational conductive charging member around said shaft.

34. The image forming apparatus according to claim 31, wherein said pressing direction changing device is a pushing device for pushing said unrotational conductive charging member in the circumferential direction of said charge target member.

35. The image forming apparatus according to claim 31, further comprising:

a foreign matter collecting device for collecting the foreign matters dropped when the pressing direction of said unrotational conductive charging member changes.

* * * * *

UNITED STATES PATENT AND TRADEMARK OFFICE

CERTIFICATE OF CORRECTION

PATENT NO. : 5,940,661
DATED : August 17, 1999
INVENTOR(S) : Yagi et al.

It is certified that error appears in the above-identified patent and that said Letters Patent is hereby corrected as shown below:

On the cover page:

Replace Inventor Information with:

Masataka Yagi, Okazaki-Shi, Japan;
Tamotsu Sakuraba, Okazaki-Shi, Japan;
Tetsumaru Fujita, Amagasaki-Shi, Japan;
Narutaka Yoshida, Toyohashi-Shi, Japan;
Akira Hirota, Okazaki-Shi, Japan;
Tsugihito Yoshiyama, Toyohashi-Shi, Japan;
Masami Matsuura, Okazaki-Shi, Japan;
Yasuhiro Nakagami, Toyokawa-Shi, Japan; and
Masayasu Haga, Toyokawa-Shi, Japan.

Add the following information:

--Assignee – Minolta Co., Ltd. Osaka, Japan--.

Signed and Sealed this

Fourth Day of July, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,940,661
DATED : August 17, 1999
INVENTOR(S) : Masataka Yagi, et al It is certified that error appears in the above-identified patent and that said Letters Patent is hereby corrected as shown below:

Title Page,
Insert item [73] to read as follows:

--Assignee: Minolta Co., Ltd. Osaka, Japan--

Signed and Sealed this

Second Day of October, 2001

*Attest:*

Nicholas P. Godici

NICHOLAS P. GODICI
*Acting Director of the United States Patent and Trademark Office*

*Attesting Officer*